US007296695B2

(12) United States Patent
Perkins et al.

(10) Patent No.: US 7,296,695 B2
(45) Date of Patent: Nov. 20, 2007

(54) WORKROOM STORAGE SYSTEM

(75) Inventors: Travis Michael Perkins, Evansville, IN (US); Thomas Wesley Arent, St. Joseph, MI (US); Todd Christopher Starr, St. Joseph, MI (US); Tyree Edward Sampson, Xenia, OH (US); Kenneth J. Rasche, Evansville, IN (US); Steven Edward Tolliver, Newburgh, IN (US); Brent A. Junge, Evansville, IN (US); Duane A. Schmidt, Madison, IN (US); Brian J. Stewart, Vincennes, IN (US); Mark Allen Stout, Evansville, IN (US); Wyatt A. Cline, Niles, MI (US); James W. Kendall, Stevensille, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/736,630

(22) Filed: Apr. 18, 2007

(65) Prior Publication Data

US 2007/0181517 A1 Aug. 9, 2007

Related U.S. Application Data

(60) Division of application No. 10/760,168, filed on Jan. 16, 2004, now Pat. No. 7,228,977, which is a continuation-in-part of application No. 10/462,461, filed on Jun. 16, 2003, now Pat. No. 6,926,160, which is a continuation of application No. 10/331,826, filed on Dec. 30, 2002, now Pat. No. 6,811,043.

(51) Int. Cl.
*A47F 5/08* (2006.01)

(52) U.S. Cl. ..... 211/94.01; 211/189; 312/249.8

(58) Field of Classification Search ..... 211/94.01, 211/87.01, 94.02, 106.01, 85.17, 13.1, 70.6; 312/249.8, 249.9, 249.11, 330.1; 52/36.4, 52/36.5; D25/123, 125, 138; 248/223.41, 248/224.51, 224.61, 215, 220.43, 225.11, 248/225.21

See application file for complete search history.

(56) References Cited

U.S. PATENT DOCUMENTS

| | | | |
|---|---|---|---|
| 376,070 | A | 1/1888 | Cobb |
| 1,610,626 | A | 12/1926 | Smith |
| 2,455,182 | A | 11/1948 | La Vallee |
| 2,490,494 | A | 12/1949 | Widman |
| D165,978 | S | 2/1952 | Haman et al. |
| 2,981,577 | A | 4/1961 | Trautmann |
| 3,243,246 | A | 3/1966 | Eversman et al. |
| 3,698,565 | A | 10/1972 | Weber |

(Continued)

FOREIGN PATENT DOCUMENTS

| | | | |
|---|---|---|---|
| EP | 0141787 | A2 | 5/1985 |

(Continued)

*Primary Examiner*—Jennifer E. Novosad
(74) *Attorney, Agent, or Firm*—Michael D. Lafrenz; Tara M. Hartman

(57) ABSTRACT

A space-efficient workroom organization system comprising a slotwall panel and/or slot track storage system with at least one repositionable slotwall or slot track mounted storage cabinet, and a workbench system comprising a workbench having a work surface and defining a storage recess beneath the work surface, with at least one mobile storage cabinet.

10 Claims, 27 Drawing Sheets

U.S. PATENT DOCUMENTS

| | | | | |
|---|---|---|---|---|
| 4,002,383 | A | 1/1977 | Holloway, Jr. | |
| 4,026,616 | A | 5/1977 | Kuehl | |
| 4,050,752 | A | 9/1977 | Dykstra | |
| 4,055,362 | A | 10/1977 | Becker, III | |
| 4,211,379 | A | 7/1980 | Morgan et al. | |
| 4,272,136 | A | 6/1981 | Sengua | |
| 4,337,988 | A | 7/1982 | Schenck | |
| 4,365,854 | A | 12/1982 | Waller | |
| 4,408,642 | A | 10/1983 | Jeruzal et al. | |
| 4,457,140 | A | 7/1984 | Rastelli | |
| 4,591,058 | A | 5/1986 | Amstutz et al. | |
| 4,607,753 | A | 8/1986 | Radek | |
| 4,615,448 | A | 10/1986 | Johnstonbaugh | |
| 4,805,783 | A | 2/1989 | Mayer | |
| 4,809,479 | A | 3/1989 | Tierno et al. | |
| D307,260 | S | 4/1990 | Happy et al. | |
| 4,961,295 | A | 10/1990 | Kosch, Sr. et al. | |
| 5,121,578 | A | 6/1992 | Holz | |
| 5,196,255 | A | 3/1993 | Cohen | |
| 5,205,629 | A | 4/1993 | Simons | |
| 5,224,531 | A | 7/1993 | Blohm | |
| D338,076 | S | 8/1993 | Current | |
| 5,360,121 | A | 11/1994 | Sothman | |
| 5,412,912 | A | 5/1995 | Alves | |
| 5,666,887 | A | 9/1997 | Grabowski et al. | |
| 5,711,115 | A | 1/1998 | Wirt | |
| D393,907 | S | 4/1998 | Current | |
| D393,909 | S | 4/1998 | Current | |
| D395,089 | S | 6/1998 | Current | |
| 5,791,093 | A | 8/1998 | Diamond | |
| D397,803 | S | 9/1998 | Current | |
| D399,010 | S | 9/1998 | Current | |
| D399,012 | S | 9/1998 | Current | |
| D400,270 | S | 10/1998 | Current | |
| 5,819,490 | A | 10/1998 | Current | |
| D403,085 | S | 12/1998 | Current | |
| D404,148 | S | 1/1999 | Laskowski et al. | |
| 5,857,578 | A | 1/1999 | Fishman | |
| 5,899,344 | A | 5/1999 | Current et al. | |
| 5,941,026 | A | 8/1999 | Eisenreich et al. | |
| 5,944,203 | A | 8/1999 | Vlah et al. | |
| D414,567 | S | 9/1999 | Burt et al. | |
| 5,984,439 | A | 11/1999 | Orr et al. | |
| 6,047,750 | A | 4/2000 | Jensen | |
| 6,113,201 | A | 9/2000 | Bauer | |
| 6,134,846 | A | 10/2000 | Lamb | |
| 6,164,467 | A | 12/2000 | DePottey et al. | |
| D437,706 | S | 2/2001 | Alcala et al. | |
| D438,030 | S | 2/2001 | Riga | |
| 6,202,567 | B1 | 3/2001 | Funk et al. | |
| 6,282,914 | B1 | 9/2001 | Steinhoff et al. | |
| 6,325,223 | B1 | 12/2001 | Hannen | |
| 6,393,877 | B1 | 5/2002 | Church | |
| D471,377 | S | 3/2003 | Gledhill et al. | |
| D473,664 | S | 4/2003 | Perkins et al. | |
| 6,634,631 | B2 | 10/2003 | Hebert | |
| 6,811,043 | B2 * | 11/2004 | Perkins et al. | 211/94.01 |
| 6,926,160 | B2 * | 8/2005 | Perkins et al. | 211/94.01 |
| 7,228,977 | B2 * | 6/2007 | Perkins et al. | 211/94.01 |

FOREIGN PATENT DOCUMENTS

| | | | |
|---|---|---|---|
| GB | 2142838 | A | 1/1985 |

* cited by examiner

WORKROOM STORAGE SYSTEM

CROSS-REFERENCE TO RELATED APPLICATIONS

This application is a divisional of and claims the benefit of non-provisional application Ser. No. 10/760,168, filed Jan. 16, 2004, now U.S. Pat. No. 7,228,977 which is a continuation in part of and claims the benefit of non-provisional application Ser. No. 10/462,461, filed on Jun. 16, 2003, now U.S. Pat. No. 6,926,160, which is a continuation of and claims the benefit of non-provisional application Ser. No. 10/331,826, filed on Dec. 30, 2002, now U.S. Pat. No. 6,811,043.

BACKGROUND OF THE INVENTION

1. Field of the Invention

Generally, the invention relates to a workroom storage system for organizing the tools and supplies found in workrooms, especially garages. More specifically, the invention relates to a space-efficient workroom storage system providing both wall mounted storage and cabinet storage, with a combination of slotwall panels, slot tracks, cabinets removably mounted to the slotwall panel and/or slot tracks, and a workbench in combination with mobile storage cabinets that are stowable beneath the workbench.

2. Description of the Related Art

There has long been a need for organized storage in workrooms, whether the workroom is a dedicated workshop, a garage, or any other room, since workrooms by their very nature tend to house many types of tools and equipment, along with general supplies and supplies for the tools and equipment. Past solutions to providing organized storage in workrooms were based on the operator selecting unrelated organization systems and combining them as operator saw fit, without an integrated system. The organization systems often reflected a hodgepodge of non-integrated solutions, such as fixed wall cabinets, pegboards, and workbenches with internal storage, which collectively did not provide a space-efficient solution. That is, the resulting combination of components comprising the operator-selected organization system, often consumed more space in the workroom than what was necessary, which limited the amount of storage and/or work area in the workroom. Therefore, there is still a need for a space-efficient, integrated workroom organization system that helps the operator maximize both the storage of tools and supplies and the useful area of the workroom.

SUMMARY OF THE INVENTION

The invention provides a unique solution to the need for space-efficient, organized storage for a workroom via a workroom organization system comprising at least one slot track. The slot track has a plurality of slots with at least one undercut sidewall with adjoining slots forming a slat having edges defined by the slots. The slots further have a bottom wall generally parallel to and spaced inwardly from the face of the at least one slat. The organization system includes one or more removable mounting brackets having a support portion for attaching a device to the bracket. The mounting brackets include a first "J" shaped hook on one edge of the support portion opening in a first direction to hook over an edge of a slat into the undercut sidewall. The mounting brackets include a second "J" shaped hook on an opposite edge of the support portion opening in the first direction to hook over an edge of the adjoining slot into the undercut sidewall.

Another aspect of the invention provides a unique solution to the need for space-efficient, organized storage for a workroom via a workroom organization system comprising at least one slotwall panel and at least one slot track. The slotwall panel has a plurality of slots with at least one undercut sidewall forming a plurality of slats having edges defined by the slots. The slots in the slotwall panel have a bottom wall generally parallel to and spaced inwardly from the face of the slats. The slot track has two slots with at least one undercut sidewall forming a slat having edges defined by the slots. The slots in the slot track have a bottom wall generally parallel to and spaced inwardly from the face of the slat. The organization system includes one or more removable mounting brackets usable on the slotwall panel and on the slot track. The mounting brackets include a support portion for attaching a device to the mounting bracket and a first "J" shaped hook on one edge of the support portion opening in a first direction to hook over an edge of a slat into the undercut sidewall. The mounting brackets also include a second "J" shaped hook on an opposite edge of the support portion opening in the first direction to hook over an edge of the adjoining slot into the undercut sidewall.

Another aspect of the invention provides a unique solution to the need for space-efficient, organized storage for a workroom via a workroom organization system comprising one or more slot tracks in combination with a wall-mounted cabinet and a floor supported workbench with at least one nesting mobile storage cabinet. The organization system provides for space-efficient, organized storage of workroom items, such as tools and supplies used in a workroom. The slot tracks are mountable on a wall of the workroom and have at least two slots defining at least one slat. The organization system further includes one or more removable mounting brackets having a first "J" shaped hook on one edge opening in a first direction to hook over an edge of the at least one slat. The mounting brackets include a second "J" shaped hook opening in the first direction to hook over an edge of a slot adjoining the slat engaging the first "J" shaped hook. The wall-mounted storage cabinets have at least one mounting bracket to engage at least one slot track. The workbench has a work surface and multiple legs extending from the work surface to support the work surface above a floor and defines a workbench recess beneath the work surface. A mobile storage cabinet having a top surface located at a height such that the at least one mobile storage cabinet can be received within the workbench recess with the top surface underlying the work surface. The mobile storage cabinet has wheels extending from the mobile storage cabinet to support the mobile storage cabinet on the floor to ease the movement of the mobile storage cabinet into and out of the workbench recess.

The workroom organization system enables a user to mount workroom items on mounting brackets mounted on the plurality of slot tracks and to arrange the at least one wall-mounted storage cabinet, workbench and at least one mobile storage cabinet within the workroom in a manner most space-efficient for a particular workroom. The workroom organization system permits the easy relocation of the workroom items and rearrangement of the at least one wall-mounted storage cabinet, workbench, and at least one mobile storage cabinet as needed over time as the quantity and mix of workroom items changes.

Another aspect of the invention provides a unique solution to the need for space-efficient, organized storage for a workroom via a workroom organization system comprising one or more slotwall panels and one or more slot tracks in combination with other elements of the organization system. The organization system further includes one or more wall-mounted cabinets and a floor supported workbench with at least one nesting mobile storage cabinet for space-efficient, organized storage of workroom items, such as tools and supplies used in a workroom. Slotwall panels are mountable on a wall of the workroom and have multiple slots defining a plurality of slats. Slot tracks are mountable on a wall of the workroom and have two slots defining a slat. The organization system includes a plurality of removable mounting brackets having a first "J" shaped hook on one edge opening in a first direction to hook over an edge of a slat on a slotwall panel or a slot track. The mounting brackets also include a second "J" shaped hook opening in the first direction to hook over an edge of a slot adjoining the slat engaging the first "J" shaped hook. The wall-mounted storage cabinets have at least one mounting bracket having a "J" shaped hook to hook over the edge of a slat on a slotwall panel or a slot track. The workbench includes a work surface and multiple legs extending from the work surface to support the work surface above a floor and defines a workbench recess beneath the work surface. The organization system includes at least one mobile storage cabinet having a top surface located at a height such that the at least one mobile storage cabinet can be received within the workbench recess with the top surface underlying the work surface. The mobile storage cabinet has wheels extending from the mobile storage cabinet to support the mobile storage cabinet on the floor to ease the movement of the mobile storage cabinet into and out of the workbench recess.

The workroom organization system enables a user to mount workroom items on removable mounting brackets on slotwall panels or slot tracks and arrange one or more wall-mounted storage cabinets, workbench and at least one mobile storage cabinet within the workroom in a manner most space-efficient for a particular workroom. The organization system permits the easy relocation of the workroom items and rearrangement of the wall-mounted storage cabinet, workbench, and at least one mobile storage cabinet as needed over time as the quantity and mix of workroom items changes.

DESCRIPTION OF THE INVENTION

Figure 1:
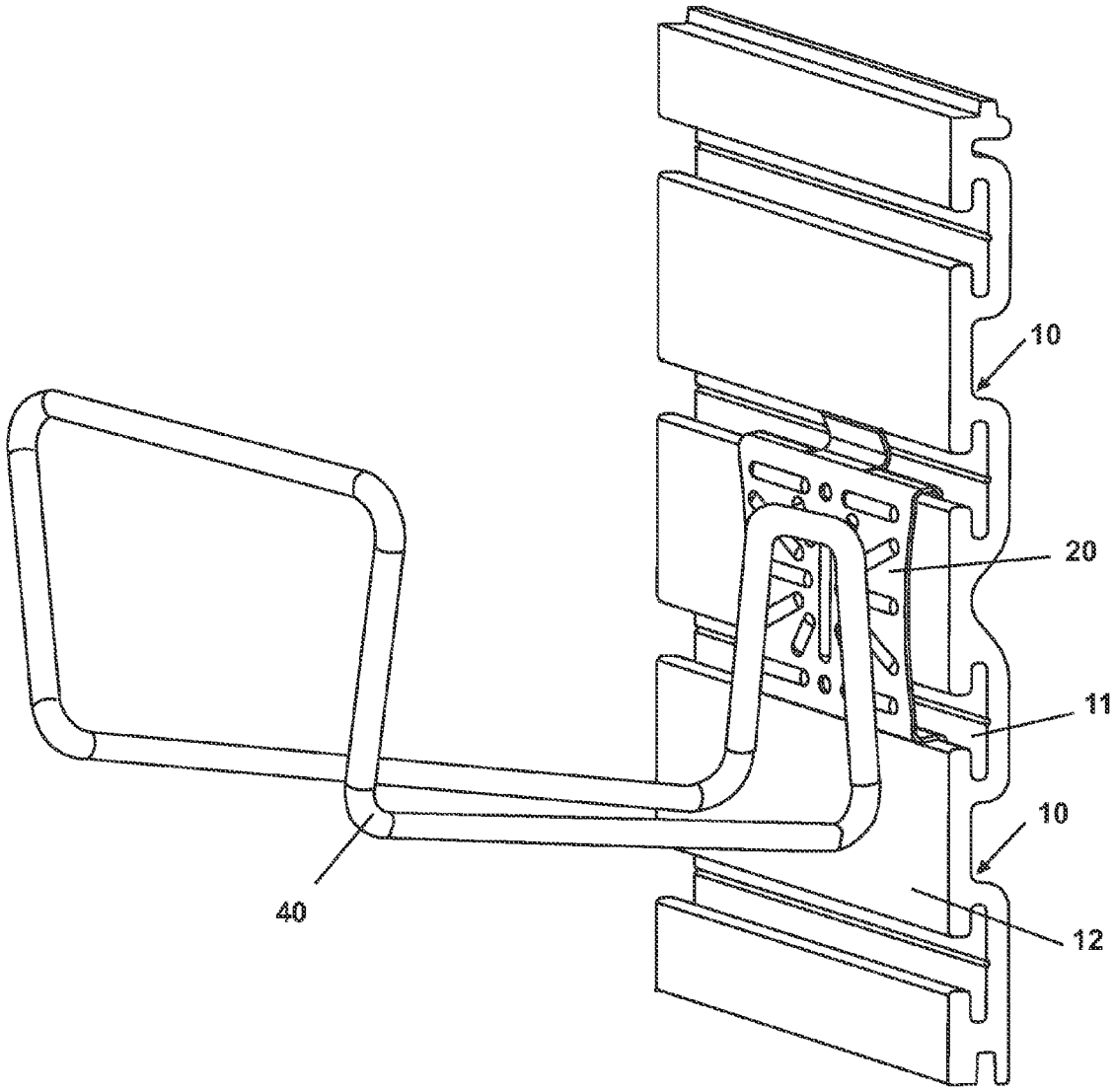
FIG. 1 is a partial perspective view of the slotwall storage system suitable for use in a space-efficient workroom storage system according to the invention, and illustrating a mounting device and hanger bracket mounted on a slotwall panel.

In accordance with the present invention a slotwall and slot track storage system incorporating a slotwall panel 10 having a plurality of generally "T" shaped slots 11 forming a plurality of generally "T" shaped slats 12 and/or a slot track 210 having a plurality of generally "T" shaped slots 211 forming at least one generally "T" shaped slat 212 are provided with a hanger bracket for mounting a device on the slotwall panel or slot track. The slotwall panel and/or slot track can be formed of extruded polyvinyl chloride material. Co-pending patent application Ser. No. 10/747,421, discloses one such material, which patent application is incorporated by reference. The slotwall and/or slot track storage system according to the present invention can be used in a residential garage to provide storage for outdoor tools and equipment. A variety of storage options can be provided as will be described below. The slotwall and/or slot track storage system can also be used in a workroom or workshop, or in commercial and industrial locations. The slotwall and/or slot track storage system can be used in conjunction with a Modular Workbench System as disclosed in U.S. Pat. No. 6,926,376, which is incorporated by reference, and the disclosure of which is copied into this application as FIGS. 19-27 and the corresponding description. Slotwall panels 10 with suitable hanger brackets can be used alone or in combination with slot tracks 210, and slot tracks 210 with suitable hanger brackets can be used alone or in combination with slotwall panels 10 and/or in combination with a Modular Workbench System mentioned above to form a flexible, space-efficient workroom storage system.

Figure 13:
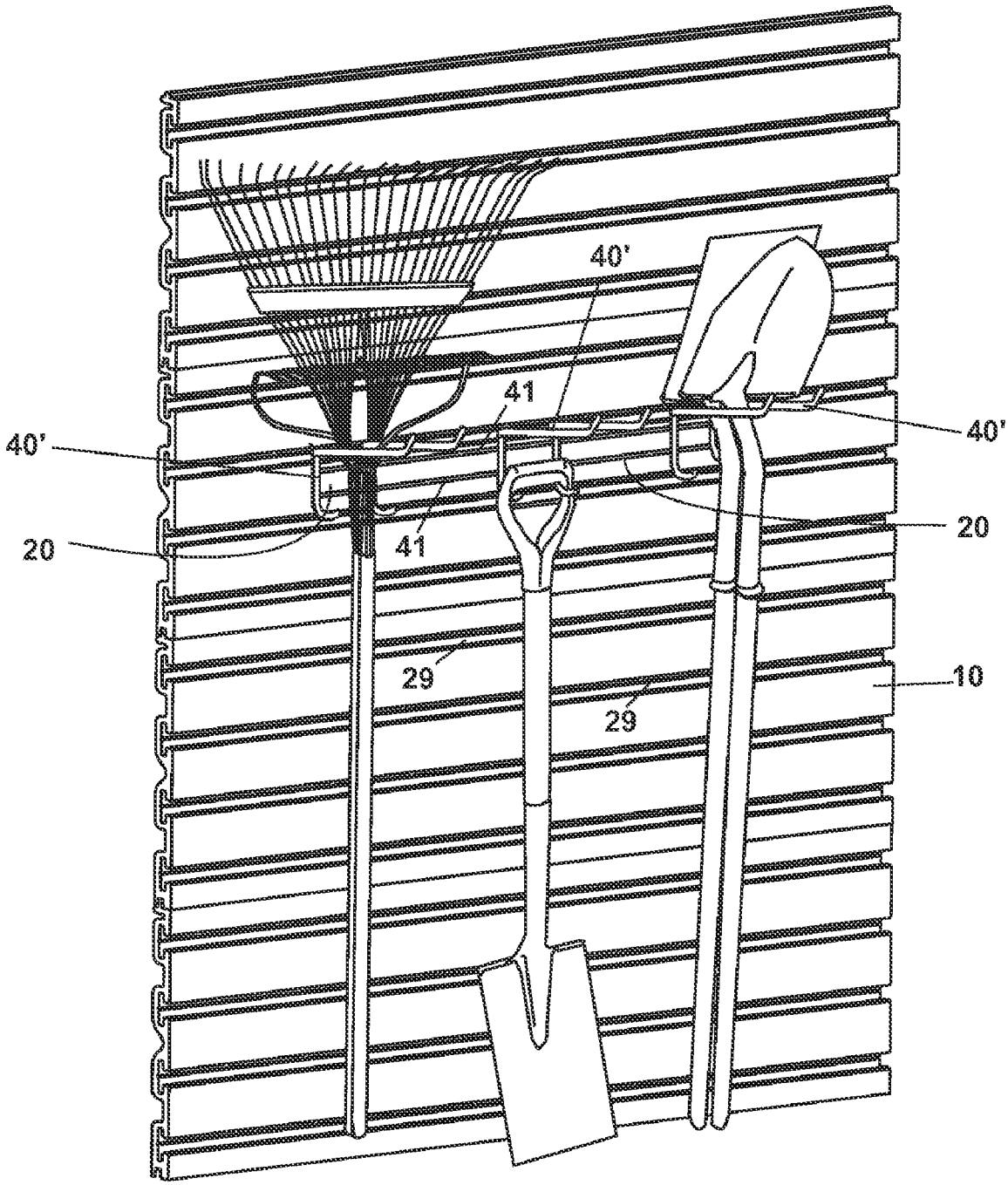
FIG. 13 is a perspective view of a multiple hook device mounted on a slotwall panel wall with plural hanger brackets and examples of tools carried on a multiple hook device.

Referring to FIG. 1, a slotwall panel 10 is shown. It should be understood that the slotwall panel 10 shown in FIG. 1 is only a portion of the panel that can extend longitudinally for any desired length. Typically, slotwall panels can be extruded in 8 feet long lengths to facilitate handling and installation. However, it should be understood that panels longer or shorter that 8 feet can fabricated and used. Further, a single panel can be used or an entire wall can be covered with panels as shown in FIG. 13. One embodiment of a hanger bracket 20 is shown mounted on the panel 10 and is shown with one example of a hook device 40 attached to the hanger bracket 20. Other well known and available hooks and hanging devices can be attached to one or more hanger brackets 20 as will be understood by one skilled in the art. While a few examples of types of hook and other storage devices that can be attached to one or more hanger brackets are disclosed in this application, one skilled in the art will understand that there are many available hooks and storage devices available on the market that could be used with the brackets and slotwall panels according to this invention.

Figure 2:
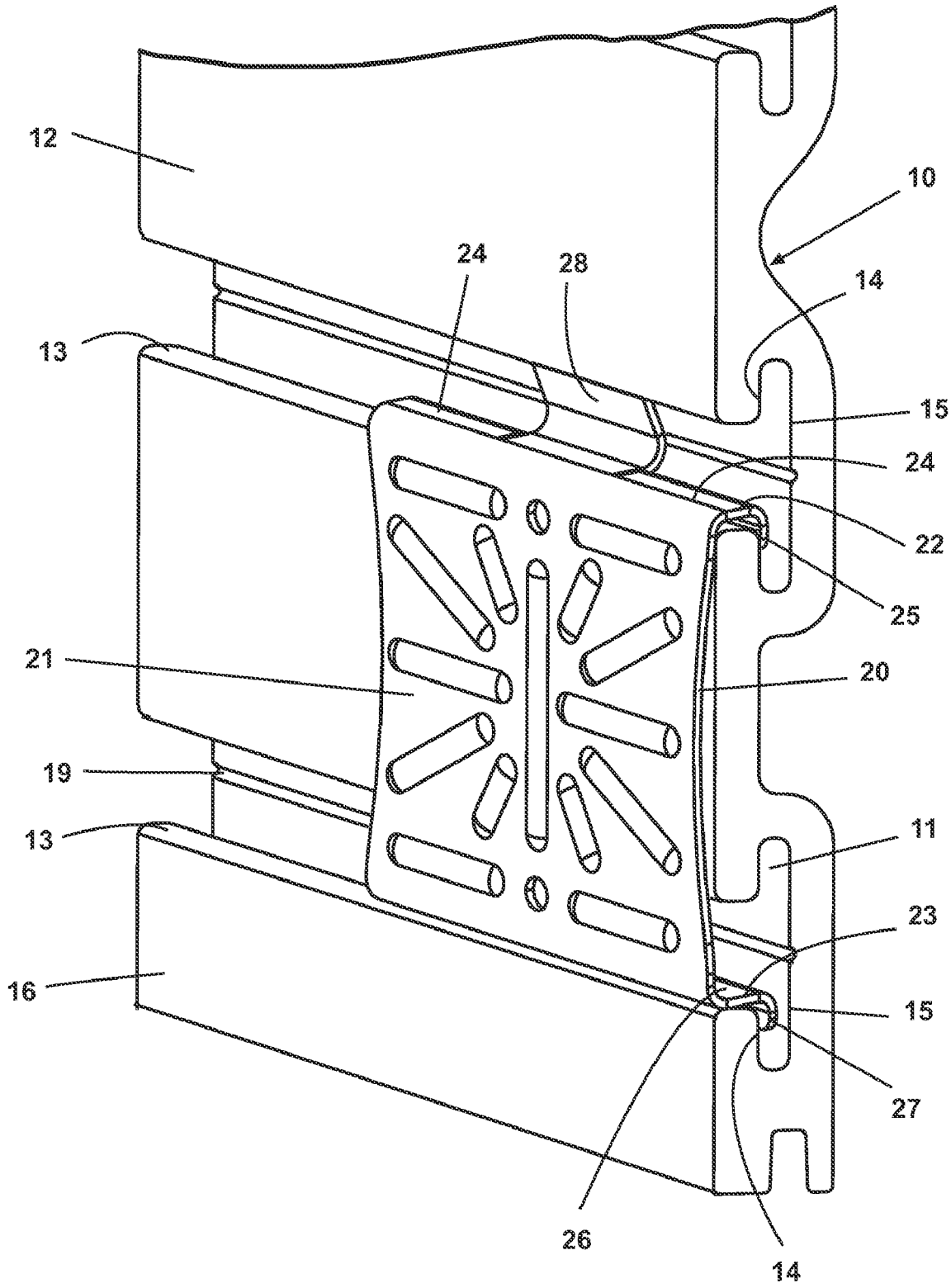
FIG. 2 is an enlarged perspective view of a portion of the slotwall panel with a hanger bracket mounted on the slotwall panel in an unloaded position.
Figure 3:
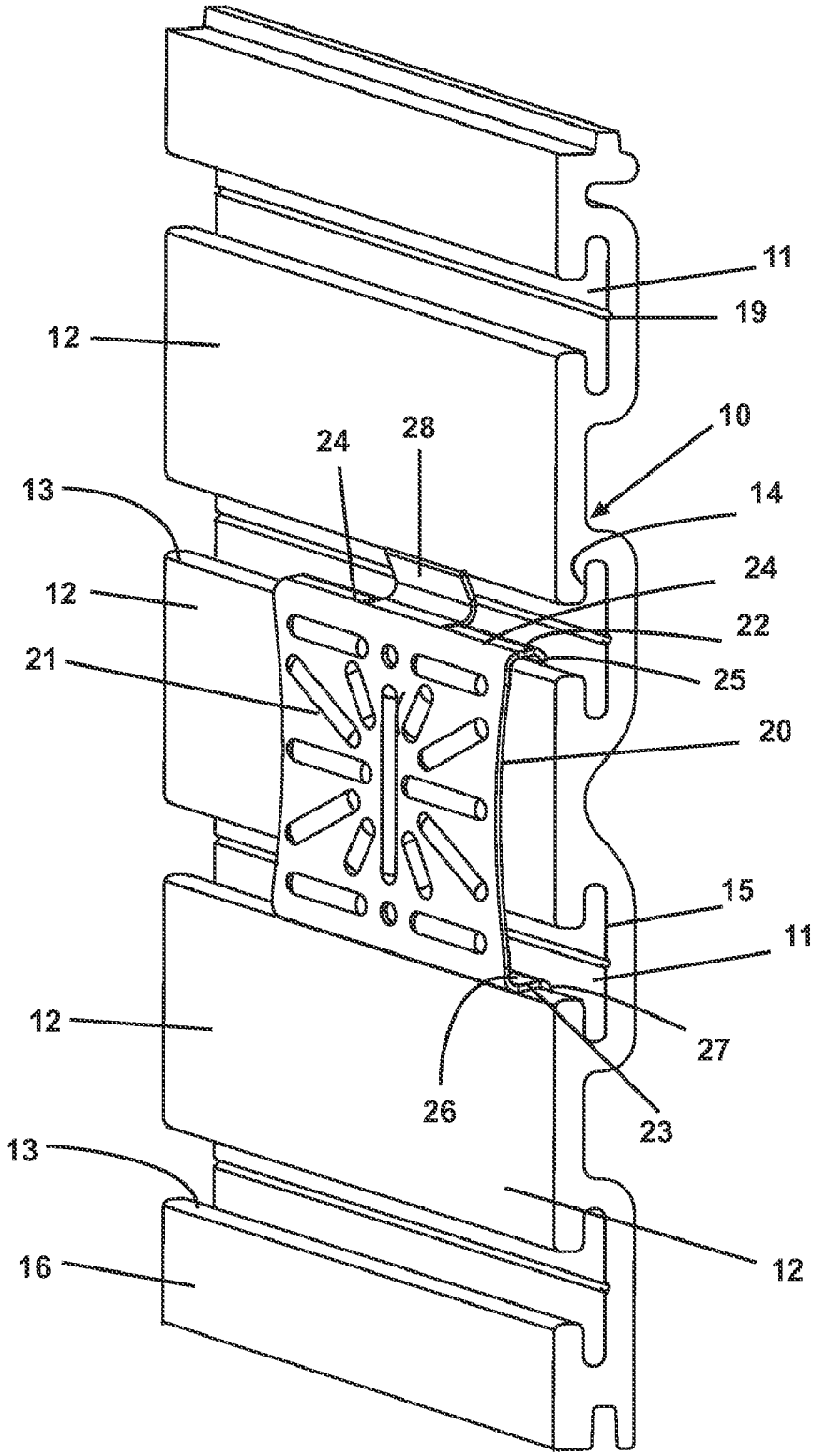
FIG. 3 is an enlarged perspective view of a portion of the slotwall panel with a hanger bracket mounted on the slotwall panel in a loaded position.

Mounting of hanger bracket 20 to a slotwall panel 10 can be understood by referring to FIG. 2 and FIG. 3. In FIG. 2 and FIG. 3 a device 40 has been omitted from hanger bracket 20 to more clearly show hanger bracket 20 on the slotwall panel 10. Those skilled in the art will understand that in use a hook device or other storage device would be attached to hanger bracket 20. Hanger bracket 20 includes a central support portion 21, a generally "J" shaped hook 22 extending from one edge of support portion 21, and a generally "J" shaped hook 23 extending from an opposite edge of support portion 21. Generally "J" shaped hook 22 includes a first leg 24 extending generally perpendicular from the edge of support portion 21 and a second leg 25 extending from the distal end of first leg 24 generally parallel to support portion 21. Generally "J" shaped hook 23 has a first leg 26 extending generally perpendicular from the edge of support portion 21 and a second leg 27 extending from the distal end of first leg 26 generally parallel to support portion 21 in the same direction as leg 25. Thus, hanger bracket 20 has two downward opening "J" shaped hooks on opposite edges of support portion 21. Hanger bracket 20 also has a spring arm 28 extending from the edge of support portion 21 that divides generally "J" shaped hook 22 into two portions. Spring arm 28 extends in an opposite direction from leg 25. Referring to FIG. 2 and FIG. 3 generally "J" shaped hook 22 hooks over an edge 13 of a generally "T" shaped slat 12. Generally "J" shaped hook 23 hooks behind the lower adjacent half slat 16 in undercut 14. Spring arm 28 is positioned behind the upper adjacent slat 12 in undercut 14.

As shown in FIG. 2, leg 27 bears against the underside of the lower adjacent half slat 16 in undercut 14 biased against the underside of the slat by the spring arm 28. The force of spring arm 28 holds support portion 21 out of contact with the face of slat 12. Thus, hanger bracket 20 transfers the load on a device 40 through hanger bracket 20 to slotwall panel 10 by contact of leg 24 on edge 13 of slat 12, the contact of leg 25 against the inside edge of slat 12 and the force of spring arm 28 against the inside of the upper adjacent slat 12 in undercut 14. Leg 26 of "J" shaped hook 23 does not normally contact edge 13 of lower adjacent slat 12. Referring to FIG. 3, when a load is placed on device 40 that generates a moment sufficient to overcome the bias of spring arm 28, hanger bracket 20 pivots on "J" shaped hook 22 so that leg 27 engages the bottom wall 15 of "T" shaped slot 11. When hanger bracket 20 is loaded, hanger bracket 20 transfers the load on a device 40 through hanger bracket 20 to slotwall panel 10 by contact of leg 24 on edge 13 of slat 12, the contact of leg 25 against the inside edge of slat 12, the force of spring arm 28 against the inside of upper adjacent slat 12 in undercut 14 and by contact of leg 27 against bottom wall 15 of generally "T" shaped slot 11. The length of leg 26 holds hanger bracket 20 spaced from the face of slat 12 when hanger bracket 20 is loaded by items carried on device 40 so that leg 27 rests against the bottom wall 15 of slot 11. In the event hanger bracket 20 is overloaded by items placed on device 40, the pressure on leg 24 may be sufficient to deform the edge 13 of slat 12 allowing hanger bracket 20 to move down until leg 26 engages edge 13 of lower adjacent slat 12. In an overload condition, the load is spread over two adjacent slats 12 by generally "J" shaped hooks 22 and 23 in addition to the load spread by spring arm 28 to upper adjacent slat 12 and leg 27 to the bottom wall 15. Thus, hanger bracket 20 is locked in position on slotwall panel 10 by friction due to spring arm 28 whether loaded or unloaded. Accordingly, hanger bracket 20 and its attached device, whether loaded or unloaded, can not inadvertently be knocked off or dislodged from a slotwall panel 10.

Hanger bracket 20, together with any attached device such as device 40, can be mounted to a slotwall panel 10 by inserting spring arm 28 into the undercut 14 in a slot 11 far enough under the upper adjacent slat 12 for leg 25 to clear edge 13 of slat 12. Hanger bracket 20 can then be pivoted down against the moment of spring arm 28 until leg 27 clears the lower adjacent slat edge 13. Hanger bracket 20 can then be slid down over slat 12 until leg 25 rests on edge 13 with leg 27 bearing against the underside of the lower adjacent slat 12 in undercut 14. As mentioned above, hanger bracket 20 will be held in place by friction resulting from the moment of spring arm 28 bearing against the inside surface of the upper adjacent slat 12.

Figure 4:
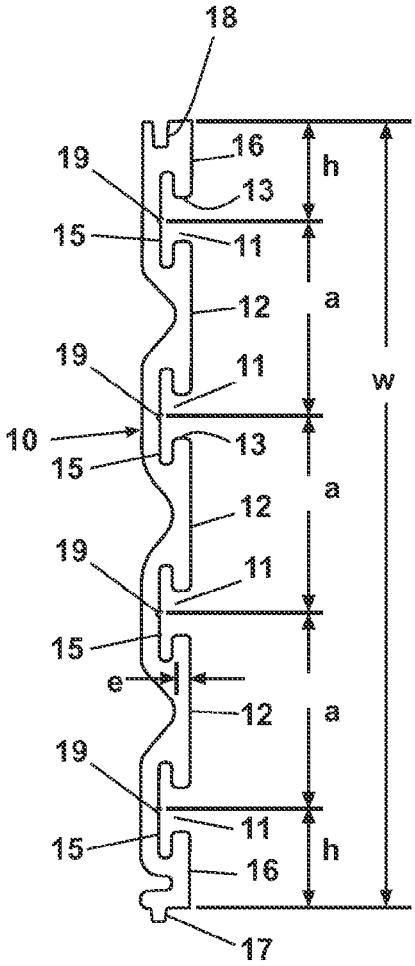
FIG. 4 is an end view of a slotwall panel showing the spacing of the generally "T" shaped slots.
Figure 4A:
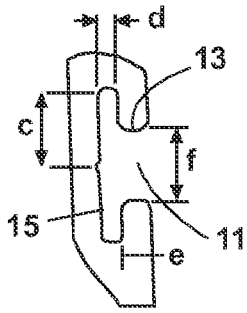
FIG. 4A is an enlarged end view of a portion of a slotwall panel showing the configuration of a generally "T" shaped slot.

Turning to FIG. 4, a slotwall panel 10 can include four generally "T" shaped slots 11 that form three generally "T" shaped slats 12 and two half slats 16, one on each edge of panel 10. One edge of slotwall panel 10 can include a projecting connecting rib 17 and the other edge can include a mating connecting groove 18. As shown in FIG. 1, rib 17 and connecting groove 18 connect adjacent panels and, when so joined, the half width slats 16 of the adjacent panels form a full width slat.

As shown in FIG. 1 and FIG. 4, the bottom wall 15 of the generally "T" shaped slots 11 includes a longitudinal alignment groove 19 in the center of bottom wall 15. Alignment groove 19 can facilitate mounting of slotwall panels on a wall. Alignment groove 19 can provide a locating function to allow screws or other mounting devices to be aligned along slotwall panel sections. In a wall installation, screws 29 (see FIG. 13) can be driven through the slotwall panel along groove 19 into studs supporting the wall to mount the slotwall panel or panels to the wall as is well known to those skilled in the art. Mounting of plural slotwall panels is facilitated by connecting rib 17 and connecting groove 18 since another slotwall panel can be placed on a slotwall panel already attached to a wall and the slotwall panel will remain in place until fastened to the wall by screws or other suitable fasteners. Normally slotwall panels 10 can be mounted to a wall with connecting rib 17 directed up and connecting groove 18 directed down over rib 17 of an adjacent panel 10 if an adjacent panel is already mounted. Those skilled in the art will recognize that slotwall panels 10 can be mounted to a wall in the opposite direction if so desired, i.e. with rib 17 directed down and connecting groove 18 directed up. Applicants have found that locating the joint between adjacent slotwall panels in the center of a slat provides a stronger slotwall structure since torsional loads are minimal in the center of a slat as compared to joint locations in a slot or at an edge of a slat.

Figure 4B:
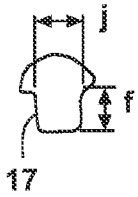
FIG. 4B is an enlarged end view of a portion of a slotwall panel showing the configuration of a connecting rib on the edge of a slotwall panel.
Figure 4C:
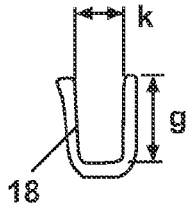
FIG. 4C is an enlarged end view of a portion of a slotwall panel showing the configuration of a connecting groove on the edge of a slotwall panel.
Figure 4D:
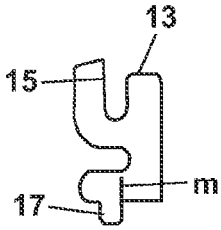
FIG. 4D is an enlarged end view of a portion of a slotwall panel showing the location of a connecting rib on the edge of a slotwall panel.
Figure 4E:
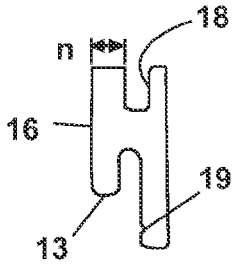
FIG. 4E is an enlarged end view of a portion of a slotwall panel showing the location of a connecting groove on the edge of a slotwall panel.

Referring to FIG. 4 through FIG. 4E, the dimensions of one embodiment of a slotwall panel 10 can be as provided in the following table. It should be understood that the following dimensions are approximate and that slotwall panels having different dimensions can be provided in accordance with the invention as desired.

| Description | Reference | Dimension (mm) |
|---|---|---|
| Width of slotwall panel 10 | w | 305 |
| Center to center of "T" shaped slots 11 | a | 76.2 |
| Width of "T" shaped slot opening | b | 17 |
| Center of slot to end of undercut 14 | c | 18.5 |
| Depth of undercut 14 | d | 5 |
| Thickness of slat 12 | e | 7 |
| Length of rib 17 | f | 5 |
| Depth of groove 18 | g | 10 |
| Center of slot 11 to edge of panel 10 | h | 38.1 |
| Width of rib 17 | j | 5.75 |
| Width of groove 18 | k | 6 |
| Rib 17 to face of panel 10 | m | 9 |
| Groove 18 to face of panel 10 | n | 9 |

Figure 5:
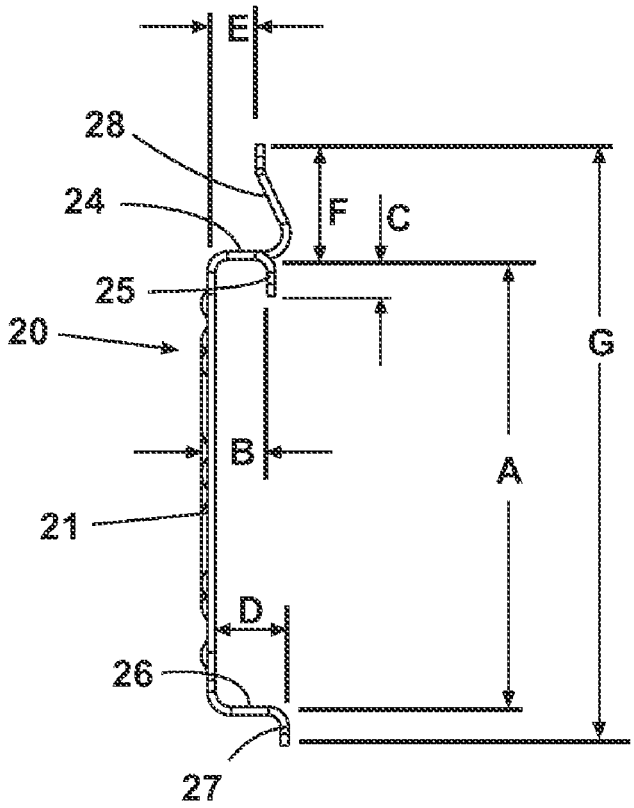
FIG. 5 is an end view of a hanger bracket showing the configuration of the generally "J" shaped hooks.
Figure 6A:
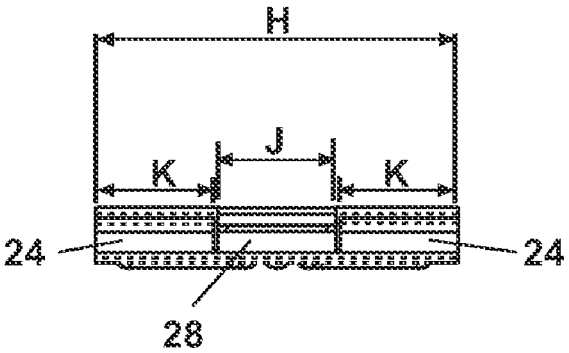
FIG. 6A is a top view of a hanger bracket showing the configuration of the spring arm and the generally "J" shaped hook adjacent the spring arm.

Referring to FIG. 2, FIG. 5 and FIG. 6A, the dimensions of one embodiment of a hanger bracket 20 adapted for use with a slotwall panel as shown in FIG. 4 through FIG. 4E can be as provided in the following table. It will be appreciated by those skilled in the art that the following dimensions are approximate and that a hanger bracket having different dimensions can be provided in accordance with the invention as desired for use with slotwall panels having different dimensions.

| Description | Reference | Dimension (mm) |
|---|---|---|
| Distance from "J" hook 22 to "J" hook 23 | A | 75.2 |
| Inside length of leg 24 | B | 8.5 |
| Inside length of leg 25 | C | 6 |
| Outside length of leg 26 | D | 12.1 |
| Offset of spring arm 28 from face of bracket | E | 6.6 |
| Distance to top of spring arm 28 from leg 24 | F | 19 |
| Overall length of bracket 20 | G | 99 |
| Overall width of bracket 20 | H | 80 |
| Width of spring arm 28 | J | 26 |
| Width of leg 24 | K | 26 |

Hanger bracket 20 can be formed of metal such as steel. When hanger bracket 20 is formed with steel, hanger bracket 20 can be stamped from sheet steel. When hanger brackets 20 are formed of steel, raised surfaces or bosses 44 as shown in FIG. 5 can be stamped in support portion 21 to provide attachment points for hook devices to be welded to the hanger bracket. After a hook device is attached to hanger bracket 20, the hanger bracket can be finished as desired such as by painting the entire hanger bracket and hook.

Figure 6B:
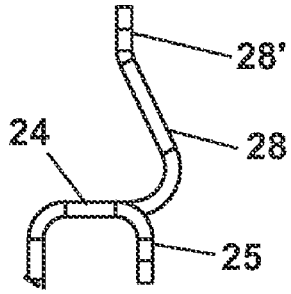
FIG. 6B is an end view of an enlarged end view of a portion of a hanger bracket showing the spring arm configuration.

Referring to FIG. 6B, spring arm 28 can extend up from first leg 24 at an acute angle of approximately 65°. As also shown in FIG. 6B the distal end 28' of spring arm 28 can be bent to extend generally parallel to support portion 21 and leg 25. Referring to the embodiment shown in FIG. 4 through FIG. 4E, FIG. 5 and FIG. 6B the function of spring arm 28 can be seen. The thickness e of a generally "T" shaped slat can be 7.0 mm and the offset E of spring arm 28 can be 6.6 mm. When a hanger bracket 20 is installed on a slotwall panel 10 with spring arm 28 positioned behind an adjacent generally "T" shaped slat in undercut 14 and generally "J" shaped hook 22 is hooked over an edge 13 of a generally "T" shaped slat, interference of the distal end of the spring arm 28 with the inside of the adjacent "T" shaped slat will tend to rotate hanger bracket 20 away from the face of slotwall panel 10. When generally "J" shaped hook 22 is hooked over and engages an edge 13 of a generally "T" shaped slat 12, hook 23 will be positioned adjacent edge 13 of a lower adjacent generally "T" shaped slat 12. Leg 27 will be positioned behind the lower adjacent generally "T" shaped slat 12 in undercut 14. The moment produced by spring arm 28 pressing against the inside of upper adjacent "T" shaped slat 12 will drive leg 27 into contact with the inner surface of lower adjacent generally "T" shaped slat 12 thus friction locking hanger bracket 20 in place. When a device such as a hook device 40 is attached to support portion and a load is placed on the hook device, the downward force on the hook device will drive hanger bracket 20 toward slotwall panel 10 until leg 27 engages the bottom wall 15 of the generally "T" shaped slot 11. The outside length D of leg 26 can be 12.1 mm and can be slightly greater than the depth d of undercut 14 which can be 5.0 mm plus the thickness e of slat 12 which can be 7.0 mm. Thus, hanger bracket 20 can be held out of contact with the face of slat 12 over which it is installed, whether loaded or unloaded. The distance A from the inside of first leg 24 of "J" shaped hook 22 to the inside of first let 26 of "J" shaped hook 23 can be 75.2 mm compared to the center to center spacing a of slots and slats which can be 76.2 mm. When hanger bracket 20 is installed on a generally "T" shaped slat 12 with leg 24 of "J" shaped hook 22 engaging an edge 13, leg 26 of "J" shaped hook 23 will not engage edge 13 of adjacent slat 12. Thus, hanger bracket 20 can pivot between the position shown in FIG. 2 to the position shown in FIG. 3 as a load is applied to hanger bracket 20 by an attached hook device such as 40.

Figure 7:
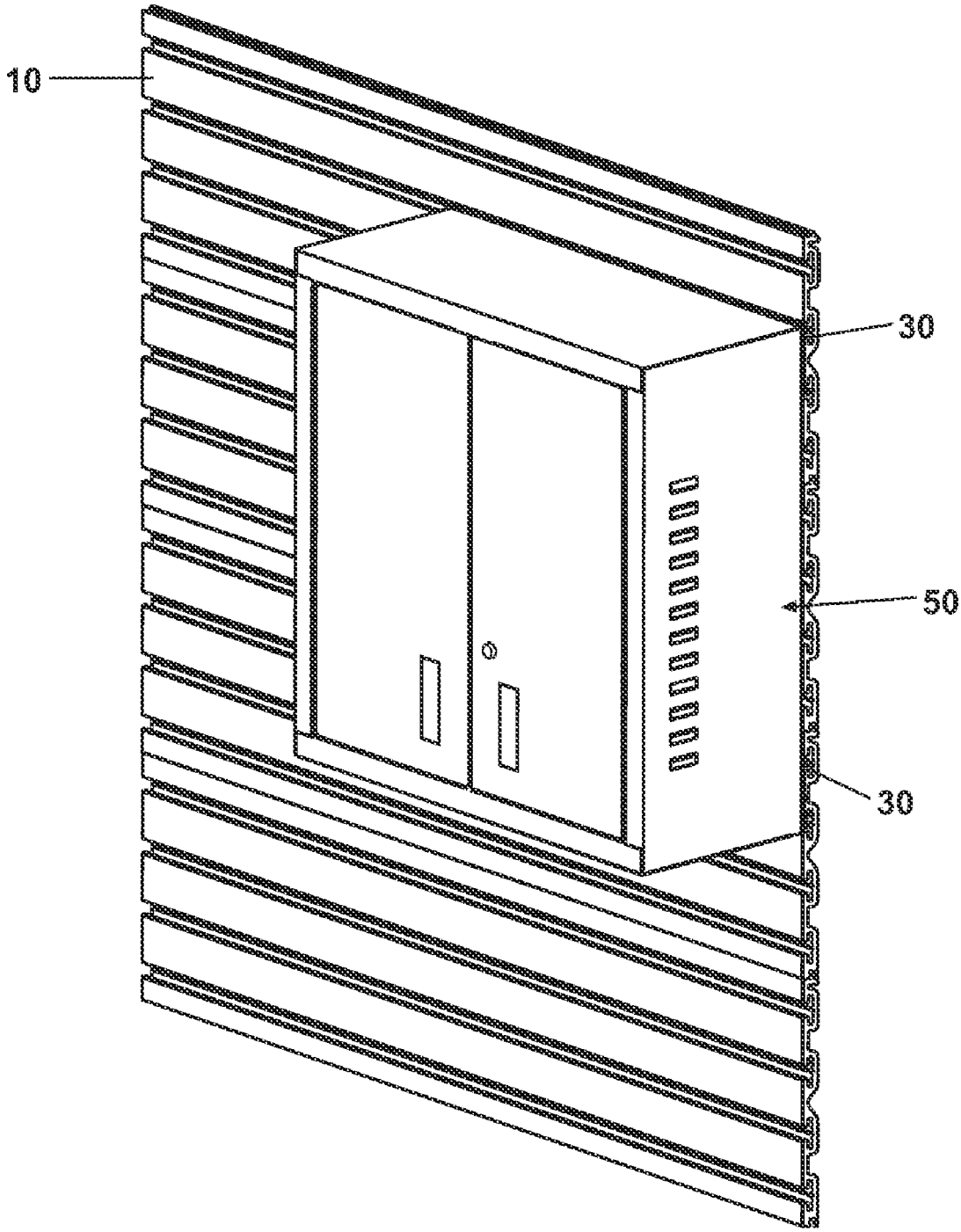
FIG. 7 is a partial front perspective view of a cabinet having plural cabinet brackets mounted on a slotwall panel.
Figure 8:
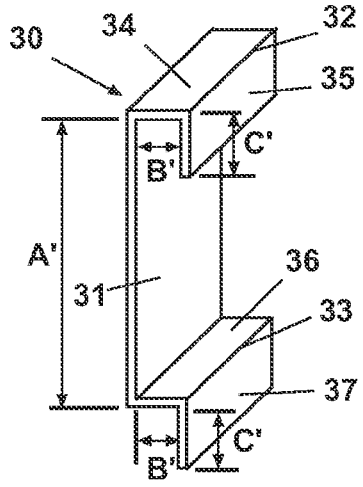
FIG. 8 is a perspective view of a cabinet bracket showing two generally "J" shaped hooks and the configuration of the cabinet bracket.
Figure 8A:
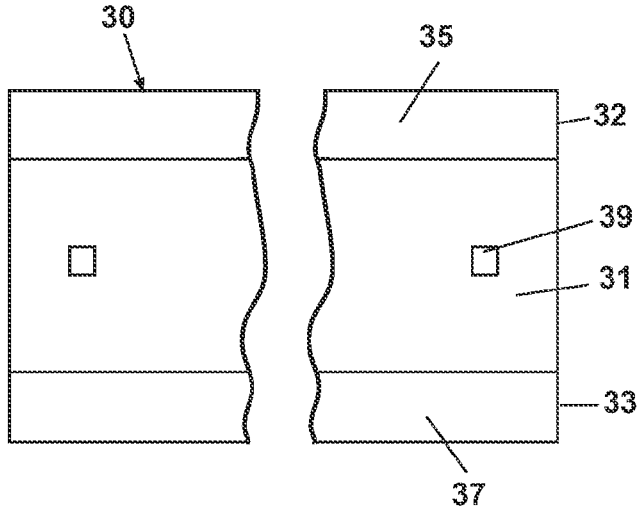
FIG. 8A is a partial front view of a cabinet bracket showing mounting holes.

Referring to FIG. 7, FIG. 8 and FIG. 8A, a cabinet 50 is shown mounted on a slotwall panel 10. Cabinet 50 can be provided with another embodiment of hanger brackets mounted to one wall of cabinet 50. Cabinet brackets 30 can extend generally the full width of cabinet 50. Alternately, cabinet brackets 30 can extend less than the full width of cabinet 50 and multiple cabinet brackets 30 can be installed across the width of cabinet 50. Cabinet bracket 30 can include a support portion 31 for mounting the cabinet bracket 30 to a cabinet 50. A generally "J" shaped hook 32 can be provided on one edge of support portion 31. Another generally "J" shaped hook 33 can be provided on an opposite edge of support portion 31. Generally "J" shaped hook 32 can include a first leg 34 extending generally perpendicular to support portion 31 and a second leg 35 extending from the distal end of first leg 34 generally parallel to support portion 31. Generally "J" shaped hook 33 can include a first leg 36 extending generally perpendicular to support portion 31 and a second leg 37 extending from the distal end of first leg 36 generally parallel to support 31 and in the same direction as second leg 35. Cabinet brackets 30 can be dimensioned so that a cabinet bracket can be mounted to a slotwall panel without tipping the cabinet bracket 30. In order to mount a cabinet bracket without tipping the cabinet bracket 30, the length of second legs 35 and 37 should be less than width b the opening of "T" slots 11 in FIG. 4B. Similarly, the spacing of generally "J" shaped hooks 32 and 33 should correspond to center to center dimension a of the generally "T" shaped slots in FIG. 4.

Referring to FIG. 8, the dimensions of one embodiment of a cabinet hanger bracket 30 adapted for use with a slotwall panel as shown in FIG. 4 through FIG. 4F can be as provided in the following table. It will be appreciated by those skilled in the art that the following dimensions are approximate and that cabinet brackets having different dimensions can be provided in accordance with the invention as desired for use with slotwall panels having different dimensions.

| Description | Reference | Dimension (mm) |
|---|---|---|
| Distance from "J" hook 32 to "J" hook 33 | A' | 75.2 |
| Inside length of leg 34 and 36 | B' | 8.5 |
| Inside length of leg 35 and 37 | C' | 6 |

Cabinet brackets 30 can be formed of metal. Cabinet bracket 30 as shown in FIG. 8 can be formed of extruded aluminum cut to lengths corresponding to the width of the cabinet or device to which the particular cabinet bracket will be attached.

As with the case of hanger bracket 20, cabinet bracket 30 can have a dimension A' from the inside of generally "J" shaped hook 32 to the inside of generally "J" shaped hook 33 that is slightly less than the center to center dimension a of the slotwall panel in FIG. 4. When dimension A' is slightly less than the center to center dimension a of slotwall panel, the load on cabinet bracket 30 produced by cabinet 50 will be on generally "J" shaped hook 32 and first leg 34 engaging edge 13 of generally "T" shaped slat 12. Because generally "J" shaped hook 32 engages an edge 13 of a generally "T" shaped slat 12 before generally "J" shaped hook 33, cabinet bracket 30 is held parallel to slotwall panel 10 and does not tip out at the top.

Figure 9:
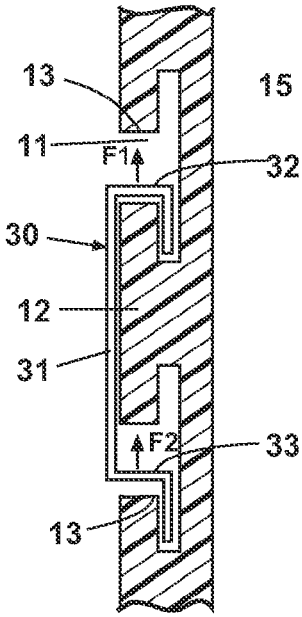
FIG. 9 is a schematic side view of an unloaded cabinet bracket mounted on a slotwall panel.
Figure 10:
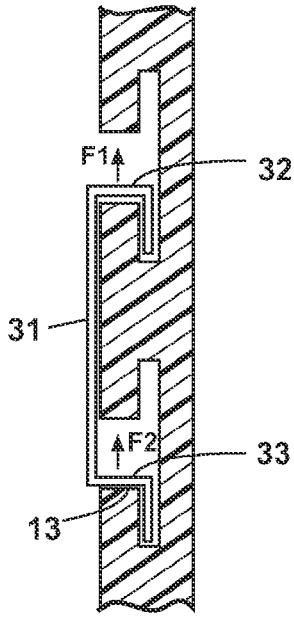
FIG. 10 is a schematic side view of a loaded cabinet bracket mounted on a slotwall panel.
Figure 11:
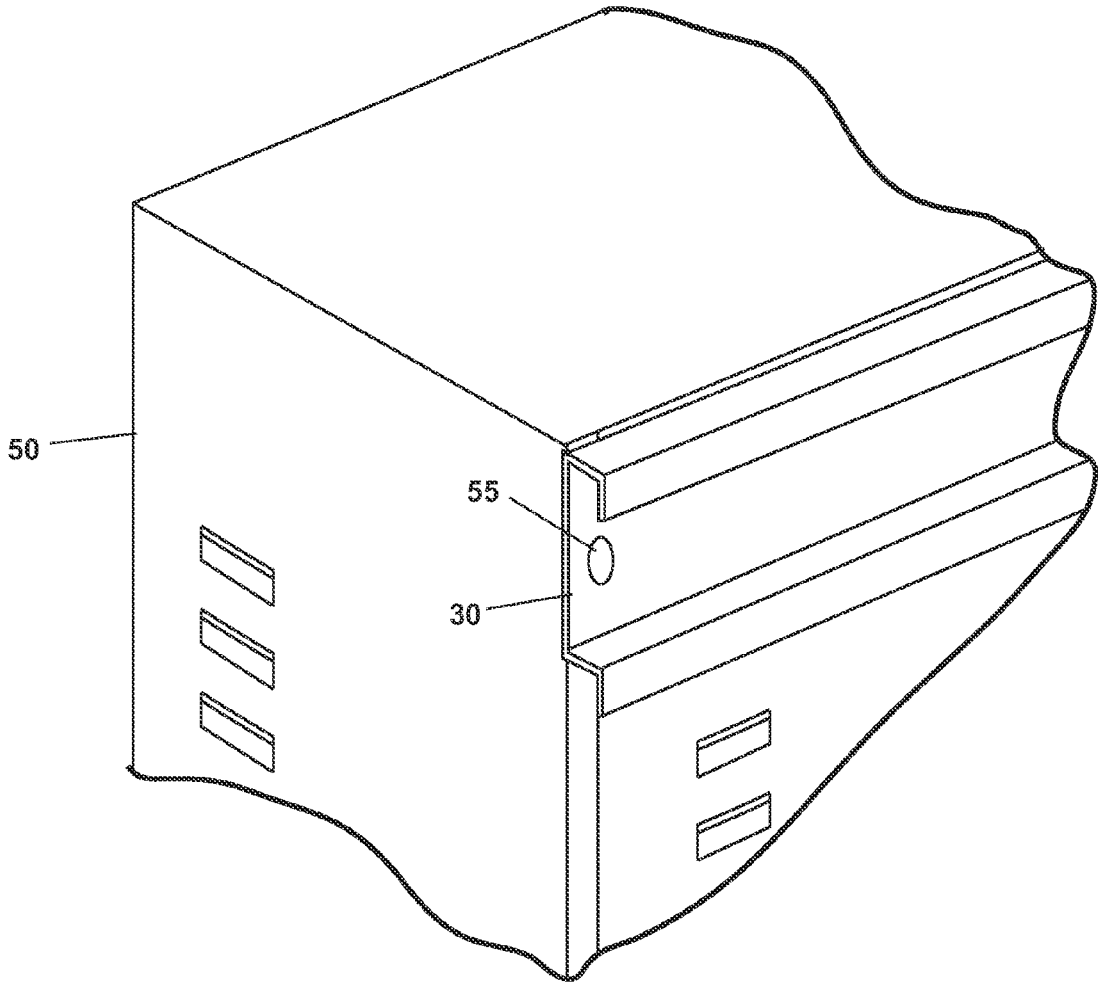
FIG. 11 is a partial rear perspective view showing a cabinet bracket mounted on a cabinet.
Figure 11A:
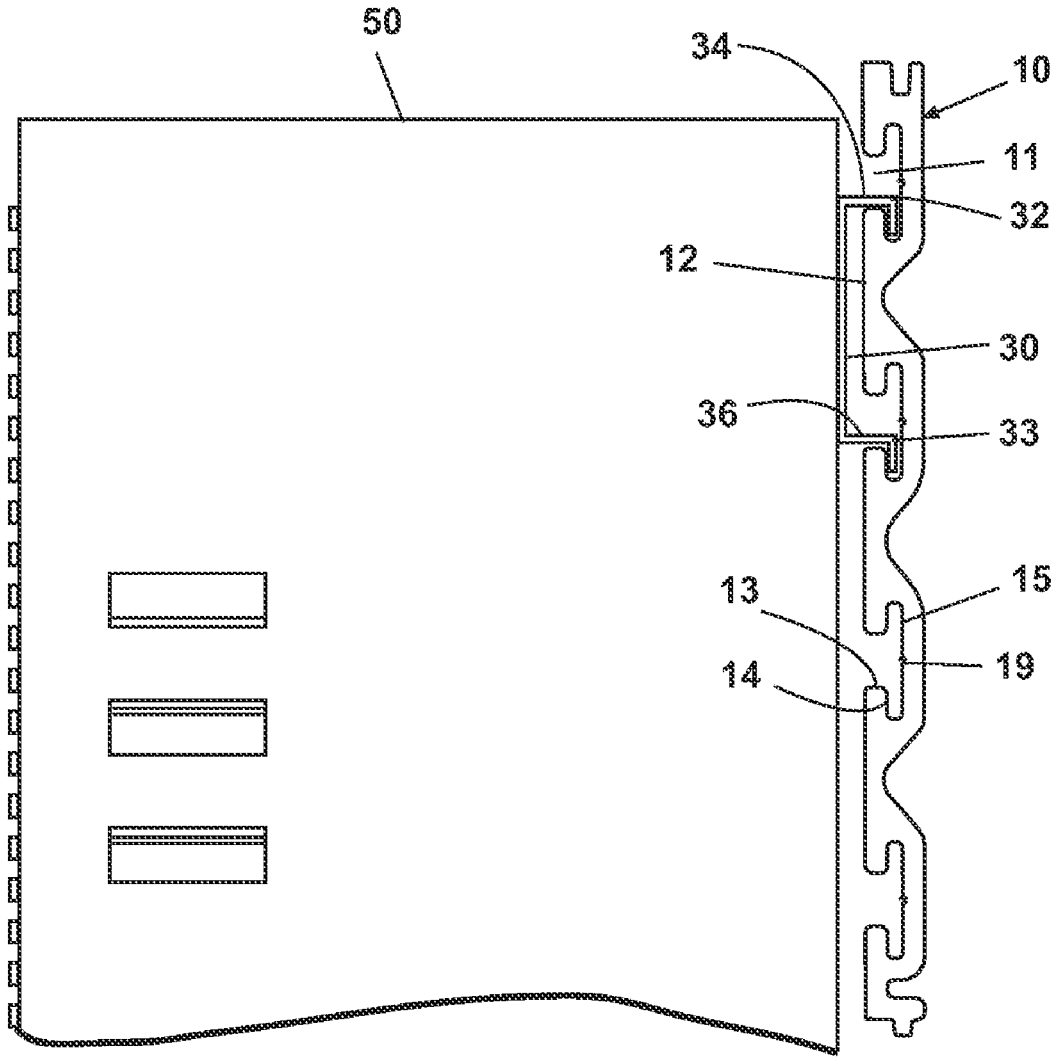
FIG. 11A is an end view showing a wall cabinet mounted on a slotwall panel.
Figure 12:
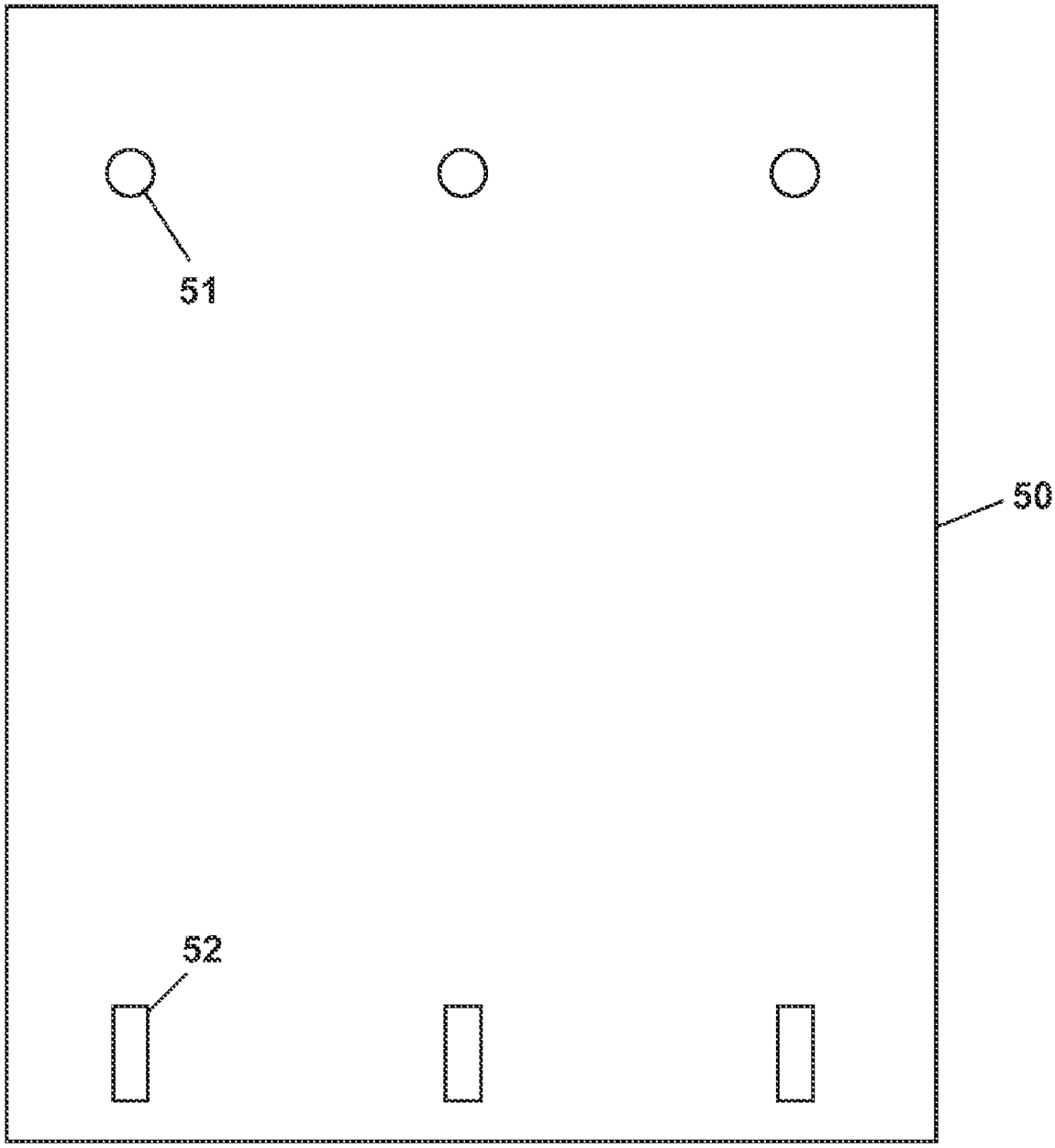
FIG. 12 is a rear elevation view of a cabinet showing mounting holes for cabinet brackets.

Referring to FIG. 9 and FIG. 10, the operation of cabinet brackets 30 can be seen. As the load on cabinet bracket 30 is increased by the load placed in cabinet 50, the edge 13 of slat 12 under generally "J" shaped hook 32 deforms allowing generally "J" shaped hook 33 to engage edge 13 of adjacent slat 12 thus increasing support for the cabinet bracket. Thus, cabinet brackets 30 initially transfer the load of cabinet 50 through generally "J" shaped hook 32 to the slotwall panel 10 by engagement of leg 34 with edge 13 of a generally "T" shaped slat 12. Generally "J" shaped hook 33 only engages the lower adjacent generally "T" shaped slat 12 when the load in cabinet 50 is sufficient to deform edge 13 of slat 12 on which leg 34 is resting.

Referring again to FIG. 8A, FIG. 11, FIG. 11A and FIG. 12 a plurality of square holes 39 can be provided in cabinet bracket 30 for mounting cabinet bracket 30 to cabinet 50. Cabinet 50 can be provided with a plurality of mounting holes 51 adjacent the top of cabinet 50 for a top cabinet bracket spaced to correspond to the spacing of mounting holes 39 in cabinet bracket 30. Mounting holes 51 can be round to permit mounting of a top cabinet bracket 30 in a fixed position adjacent the top of cabinet 50. One or more additional rows of mounting holes 52 can be provided below mounting holes 51 to allow mounting of one or more lower cabinet brackets 30. Mounting holes 52 can be vertically elongated slots to permit vertical adjustment of the lower cabinet brackets to insure that each cabinet bracket upper generally "J" shaped hook 32 engages a slat edge 13.

In order to install a cabinet 50 on a slotwall panel, a top cabinet bracket can be attached to cabinet 50 utilizing a plurality of mounting bolts 55 inserted with the head in cabinet bracket 30 and the threaded portion projecting through mounting holes 51 into cabinet 50. Mounting bolts can be a carriage bolt or similar fastening device that can be tightened without access to the head. Suitable fasteners, not shown, can be threaded on mounting bolts 55 and tightened to secure top cabinet bracket 30 to cabinet 50. Next, one or more lower cabinet brackets can be attached to cabinet 50 utilizing a plurality of mounting bolts 55 inserted with the head in cabinet bracket 30 and the threaded portion projecting through vertical slot mounting holes 52 into cabinet 50. Suitable fasteners, not shown can be threaded on mounting bolts 55 and left loose to permit adjustment of the position of the one or more cabinet brackets 30 on cabinet 50 relative to the slotwall panel 10. Cabinet 50 can then be mounted on slotwall panels that have mounted or attached to a wall structure. The top cabinet bracket 30 is first hooked on a selected slotwall panel slat 12 with leg 34 engaging a slat edge 13. Next, the lower cabinet bracket or brackets 30 are vertically adjusted so that each generally "J" shaped hook 32 engages a slotwall panel slat 12 with leg 34 engaging a slat edge 13. After the one or more lower cabinet brackets 30 are all positioned hooked over a slotwall panel slat 12 with leg 34 engaging a slat edge 13 the fasteners can be tightened securing the one or more cabinet brackets to the cabinet 50. As mentioned above, the vertically elongated mounting holes provide sufficient vertical adjustment to allow multiple cabinet brackets to be employed for mounting a cabinet to a plurality of slotwall panels 10 with each cabinet bracket transferring load from the cabinet 50 to the slotwall panel to spread the load in cabinet 50 across multiple slotwall panels 10 and slats 12.

Referring to FIG. 13, hanger brackets 20 can be combined to support plural mounting hooks 40'. FIG. 13 also illustrates yard tools carried on the mounting hooks on a slotwall storage system occupying a section of a wall. As shown in FIG. 13, slotwall panels 10 can be fastened to a wall using a plurality of fasteners such as screws 29. In the embodiment shown in FIG. 13 a plurality of screws 29 are fastened through the slotwall panels 10 in each slot 11 spaced apart by the distance between underlying studs or wall support structures. Those skilled in the art will understand that fasteners 29 can be used in alternate generally "T" shaped slots 11, or other patterns as desired depending on the anticipated loading on the slotwall panels 10. Likewise, fasteners 29 could be driven into alternate studs or wall supports. The specific mounting hooks shown and the yard tools carried are only examples to show how the slotwall storage system can be used. Those skilled in the art will understand that many other hooks or storage devices could be attached to one or more hanger brackets to store any desired objects. In the embodiment of FIG. 13, two hanger brackets can be connected with a pair of connecting rods 41 to which three mounting hooks 40' are attached. The connecting rods can be welded to hanger brackets 20 and mounting hooks 40' can be welded to connecting rods 41. The combined mounting hook device can be mounted on a slotwall panel 10 in the same manner as a single hanger bracket as described above. Those skilled in the art will recognize that the combined mounting hook device shown in the embodiment of FIG. 13 is only one possible arrangement of multiple mounting hooks and that more or less than three mounting hooks could be attached to two or more connected hanger brackets.

Figure 14:
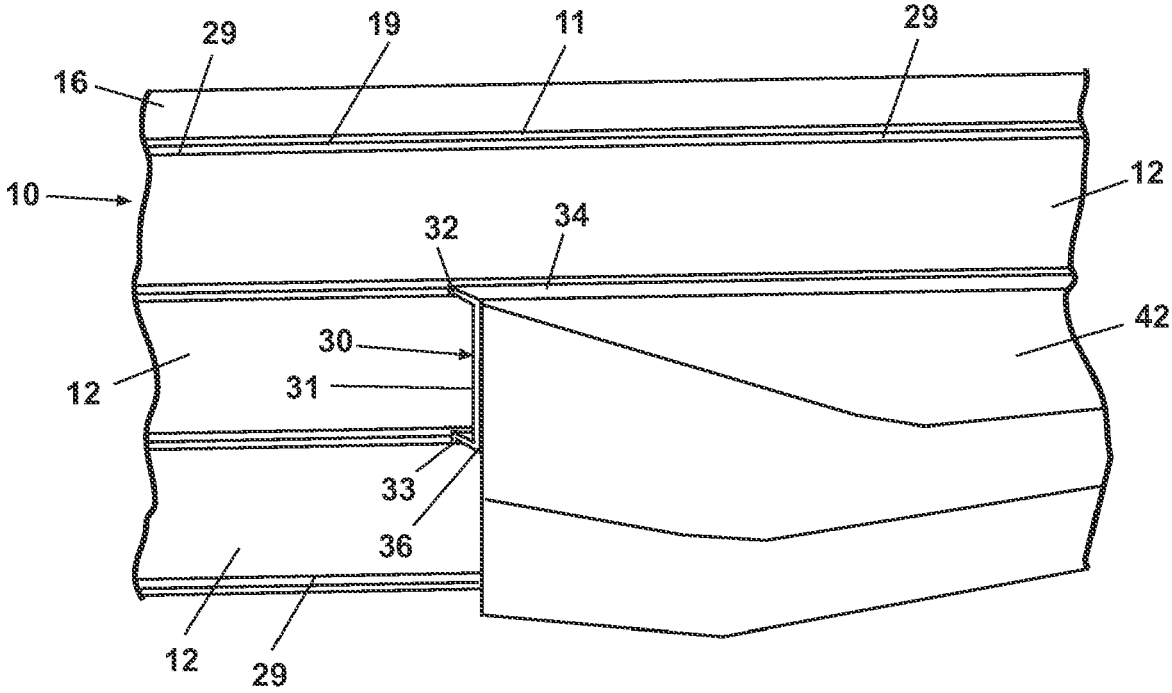
FIG. 14 is a partial perspective view of a shelf mounted on a slotwall panel with a cabinet bracket.

Referring to FIG. 14, a cabinet bracket 30 can be attached to a shelf 42 to support shelf 42 on slotwall panels 10. In the embodiment shown in FIG. 14, a cabinet bracket 30 can be attached to shelf 42 using threaded fasteners as used in connection with the cabinet as described above, or permanently attached to shelf 42 by welding. Shelf 42 can be mounted on slotwall panel 10 by inserting "J" shaped hooks 32 and 33 into adjoining slots 11 and sliding shelf 42 and cabinet bracket 30 down over adjoining slat edges 13.

As one of skill in the art should recognize, hanger brackets 20 can be combined to support a basket (not shown) on slotwall panels 10. In the embodiment two hanger brackets 20 can be attached to a basket by welding or by any other known connection means. The basket can be mounted on a slotwall panel in the same manner as a single hanger bracket as described above in detail.

Figure 15:
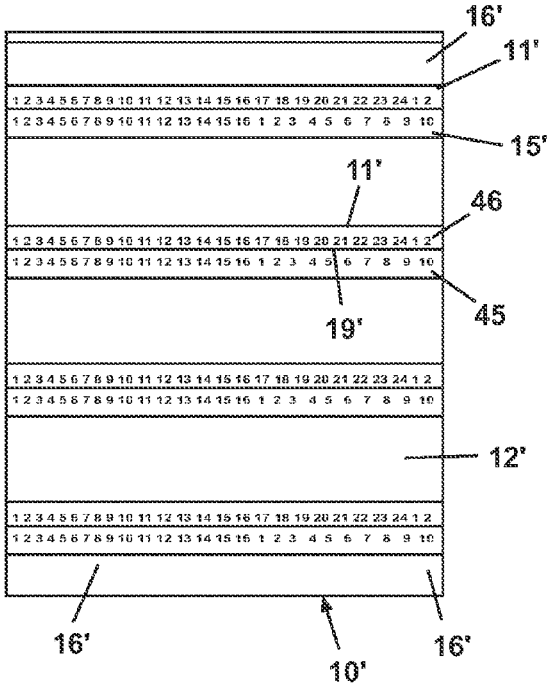
FIG. 15 is a front view of another embodiment of slotwall panel having ruler markings in the generally "T" shaped slots.
Figure 16:
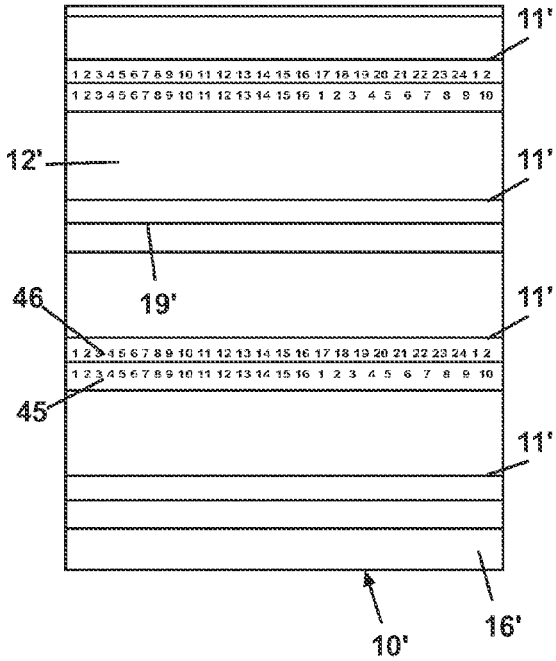
FIG. 16 is a front view of another embodiment of a slotwall panel having a different arrangement of ruler markings in the generally "T" shaped slots.

Referring to FIG. 15 and FIG. 16, another embodiment of a slotwall panel 10' is shown. In the embodiment of FIG. 15 and FIG. 16 repeating ruler markings 45 and 46 can be provided on the bottom wall 15 of generally "T" shaped slot 11' on either side of groove 19'. Ruler markings 45 can be repeating 1-16 inch marks while ruler markings 46 can be repeating 1-24 inch marks. Repeating ruler markings can facilitate mounting of slotwall panels on conventional stud wall construction. Once a stud is located for a mounting screw 29, adjacent screws can be inserted at the same number in the repeating sequence as the first screw since most stud walls are built on 16 inch or 24 inch centers. The provision of the repeating markings eliminates the need to measure and mark the location of subsequent studs for mounting screws once the first mounting screw 29 is driven into a stud. As shown in FIG. 16, the repeating markings can be provided in alternate generally "T" shaped slots 11'. Those skilled in the art will recognize that other patterns of repeating markings could be used such as in one generally "T" shaped slot per slotwall panel 10'.

Figure 17:
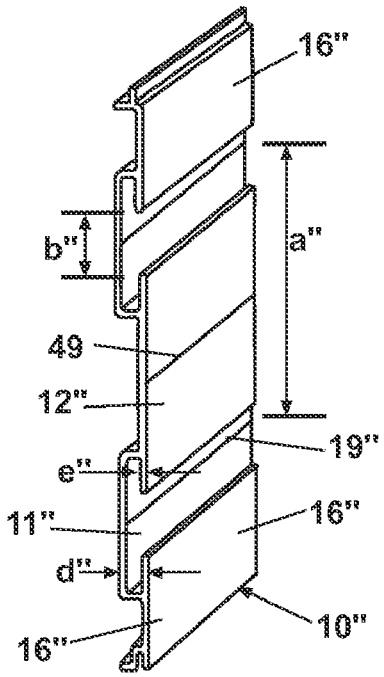
FIG. 17 is a partial perspective view of another embodiment of a slotwall panel.

Referring to FIG. 17 another embodiment of slotwall panel is shown. The slotwall panel 10" can be fabricated of metal such as extruded aluminum. The slotwall panel 10" of the embodiment shown in FIG. 17 can have dimensions a", b" and d" corresponding to the same dimensions in slotwall panel 10 as shown in FIG. 4. The slotwall panel 10" can support hanger brackets 20 and cabinet brackets 30 in the same manner as described above even though the thickness e" of slat 12" is less than the thickness e of slat 12. As shown in FIG. 17, a groove 49 can be provided in the center of slat 12". The provision of a slat groove 49 will make the appearance of slats 12" the same as a joint between adjoining slotwall panels 10" where adjoining half slats 16" meet. Those skilled in the art will recognize that a groove 49 can be provided in slat 12 of the embodiment of the slotwall panel 10 shown in FIG. 4-FIG. 4E to provide the same function as in the embodiment of FIG. 17.

Figure 18:
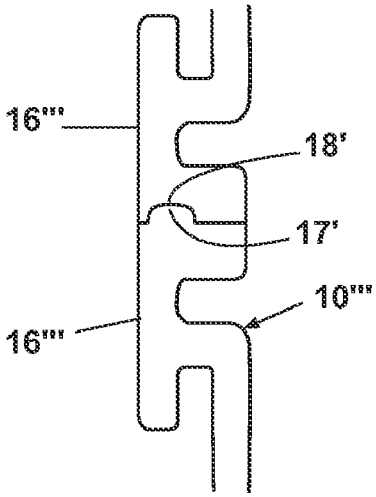
FIG. 18 is a partial end view of another embodiment of a slotwall panel having the connecting rib and connecting groove in a different position on the edge of the slotwall panel.
Figure 18A:
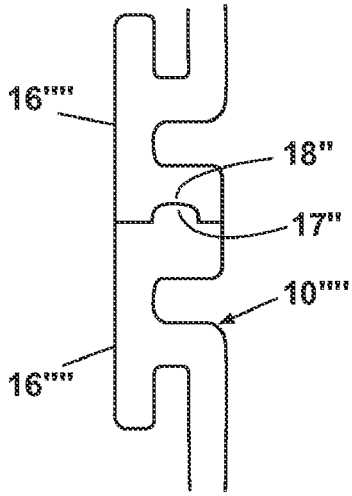
FIG. 18A is a partial end view of another embodiment of a slotwall panel having the connecting rib and connecting groove in a different position on the edge of the slotwall panel.

Referring to FIG. 18 and FIG. 18A, other embodiments of the slotwall panel are shown. In FIG. 18 slotwall panel 10''' can have a connecting rib 17' and connecting groove 18' that are offset toward half slat 16''' instead of offset toward the opposite surface of the slotwall panel as in the embodiment shown in FIG. 4-FIG. 4E. In FIG. 18A, slotwall panel 10'''' can have a connecting rib 17" and connecting groove 18" that are centered in slotwall panel 10''''. Those skilled in the art will understand that the connecting rib and connecting groove can have a configuration other than as shown in FIG. 4-FIG. 4E and FIG. 18 and FIG. 18A. Such other rib and connecting groove configurations could include semicircular, triangular, trapezoidal or other shapes. The rib and connecting groove configuration could also be interlocking with one panel hooking into and interlocking with an adjacent panel.

The material used to form slotwall panels 10 can be extruded foamed CPVC/PVC material as disclosed in co-pending patent application Ser. No. 10/747,421 mentioned above. Alternately, slotwall panels can be extruded of foamed PVC material as is known in the art. Slotwall panels can also be formed of wood panels by removing material to form the generally "T" shaped slots which in turn form the generally "T" shaped slats. Particleboard material could be used to form the slotwall panels instead of wood or extruded foamed PVC material. Particleboard slotwall panels could be formed by removing material to form generally "T" shaped slots. Alternately, particleboard slotwall panels could be formed by attaching generally "T" shaped slats to a particleboard. Plywood slotwall panels could be formed by removing material to form generally "T" shaped slots or by attaching generally "T" shaped slats as in the case of particleboard.

FIGS. 19-27 illustrate a modular workbench storage system according to the invention that provides a heavy duty workbench and storage space for one or more modules that can dock underneath the workbench to minimize the area of the consumed in the room and thereby maximize the useful area of the workroom. When combined with the slotwall storage system and wall-mounted storage cabinet previously described, the workbench storage system provides the operator of a workroom with a highly flexible and very space-efficient storage system.

Figure 19:
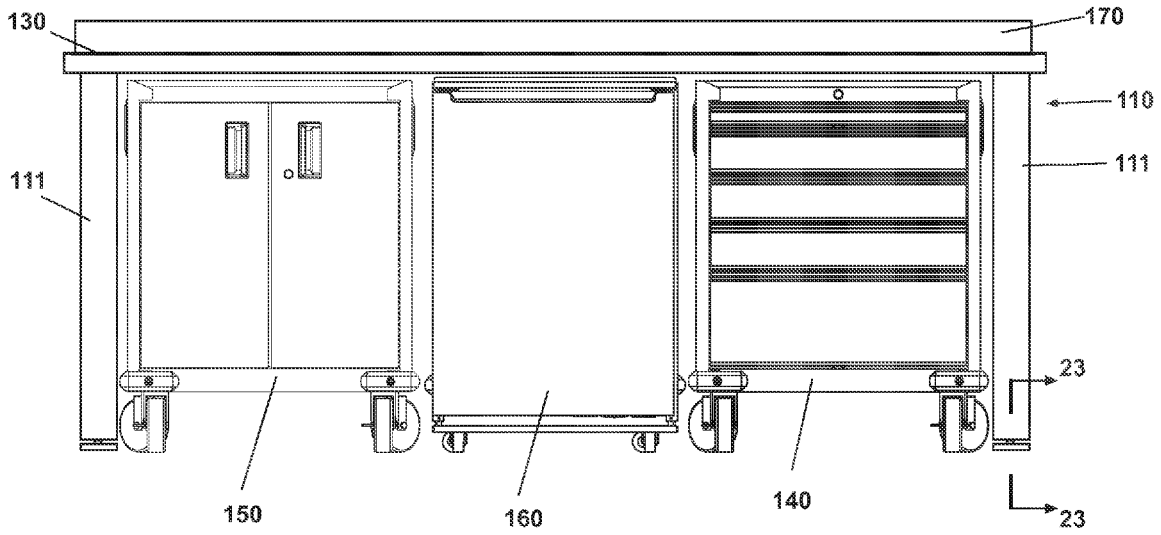
FIG. 19 is a front perspective view of the modular workbench system providing space-efficient storage and work surface for the workroom organization system of the invention.
Figure 20:
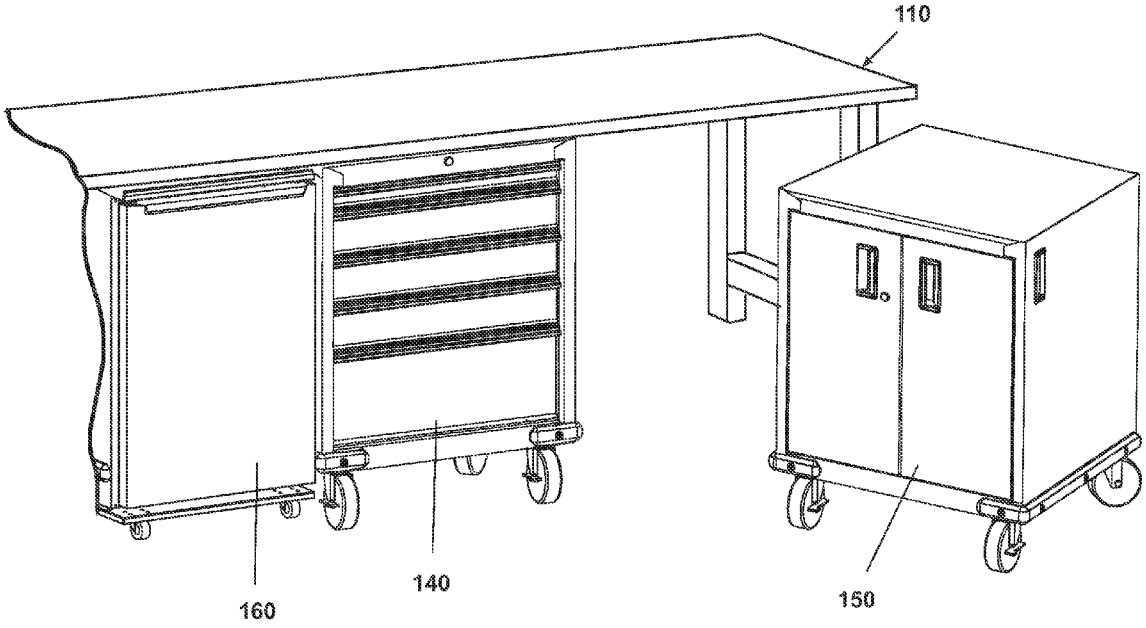
FIG. 20 is a front perspective view of the modular workbench system with one module moved out from under the workbench and positioned as an auxiliary work surface.

Referring to FIG. 19, a modular workbench system according to the invention is shown. Workbench 110 can include a leg assembly 111 at each end of the workbench and a top 130. Top 130 can be laminated hard wood or other sturdy, durable material as is well known in the art. In the embodiment shown in FIG. 19, top 130 can be 1¾ inches thick laminated hard wood maple strips that run lengthwise in top 130 to provide a strong heavy-duty work surface. The workbench 110 shown in FIG. 19 can be 8 feet long, 38 inches high and 25 inches deep to provide ample work surface and storage area for up to three modules. Those skilled in the art will understand that the length of the workbench can be longer or shorter as desired to provide space for docking two modules or more than the three modules as shown in the embodiment of FIG. 19. For example, the workbench could be made 6 feet long and provide storage space for two modules. Likewise the height and width of the workbench can be adjusted as desired. The modules can include a drawer module 140, a storage cabinet module 150 and a refrigerator module 160. Refrigerator module 160 can be a low ambient temperature refrigerator as disclosed in U.S. Pat. No. 7,191,827 incorporated by reference. Those skilled in the art will understand that other modules can be provided as desired. In addition, less than three modules can be provided for use with workbench 110 and more than one of a particular module can be used with workbench 110 as desired by the user.

The modules can be provided with heavy duty casters, as described in detail below, to facilitate movement for docking underneath the workbench 110, rearrangement of the modules underneath the workbench, or to facilitate positioning away from the workbench for cleaning under the workbench or for use as a mobile work surface. Referring FIG. 20, one of the modules, storage cabinet module 150, is shown withdrawn from under the workbench for use as a mobile work surface. While storage cabinet module 150 is shown withdrawn those skilled in the art will recognize that any or all of the modules can be so withdrawn for use as a mobile work surface or positioned elsewhere as a remote storage module.

Figure 21:
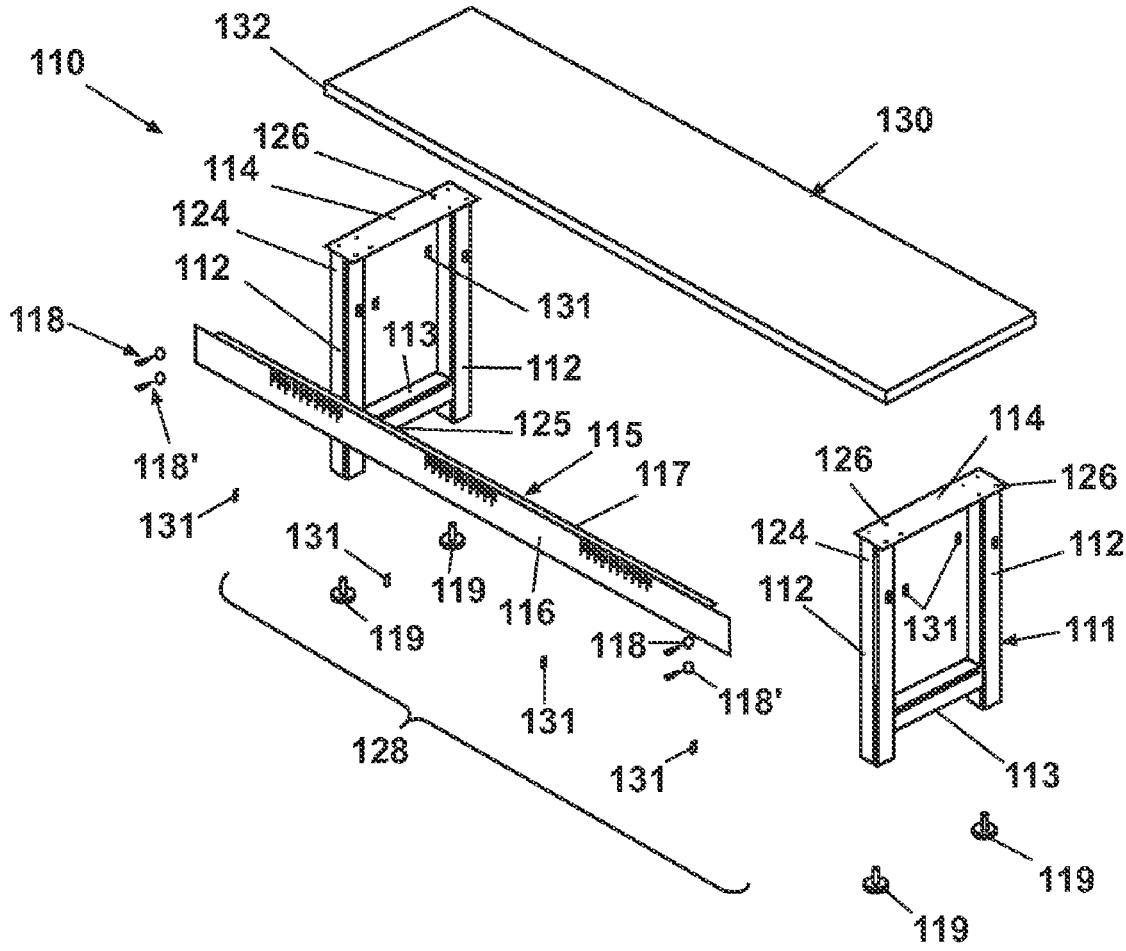
FIG. 21 is an exploded rear perspective view of the modular workbench.

Referring to FIG. 21, the workbench 110 is shown with top 130 removed and spaced from the leg assemblies 111 and stringer 115. Each leg assembly 111 can include two legs 112, a bottom spacer 113 and a top plate 114. Leg assembly 111 can be fabricated of metal such as steel, and welded together. Each of the legs 112 and bottom spacer 113 can be square tubes that can be approximately 3 inches square. Top plate 114 can be wider than legs 112 to provide a mounting flange on each side of leg assembly 112. Each top plate 114 can have a plurality of elongated mounting holes 126 provided in two rows on either side of legs 112. As shown in FIG. 21, there can be 8 elongated mounting holes 126 in top plate 114, four being adjacent each leg 112. As those skilled in the art will understand, less than 8 elongated mounting holes 126 can be provided in top plate 114, and plate 114 could be substantially the same width as legs 112 with elongated holes 126 positioned between legs 112. Mounting holes 126 can be eliminated altogether and stringer 115 can be used to attach workbench top 130 to the leg and stringer assembly 128 as described below. If mounting holes 126 are eliminated from plates 114, some alternate fastener can be used in the vicinity of the front leg 112 of each leg assembly 111 to prevent top 130 from lifting off the leg assemblies during use as will be understood by those skilled in the art.

Leg assemblies 111 can be connected with stringer 115 that can be a metal plate extending from one rear leg to the opposite rear leg. Stringer 115 can include a vertical plate 116 that can be attached to legs 112 to form a leg and stringer assembly 128 including a pair of leg assemblies 111 and a stringer 115. Stringer 115 can also include a mounting flange 117 that can be formed on the top edge of stringer 115. In the embodiment of FIG. 19 vertical plate 116 can be 6 inches wide and mounting flange 117 can be 1 inch wide. Stringer 115 can be attached to leg assemblies 111 with a plurality of mounting bolts 118 and washers 118' to the rear surface of rear legs 112 as is well known to those skilled in the art. While flat washers 118' are shown, those skilled in the art will understand that lock washers could be used instead of, or in addition to flat washers 118'. Mounting bolts 118 can be threadably attached to legs 112 by weld nuts 124 attached to rear legs 112. Stringer 115 can have a plurality of vents 127 formed in vertical plate 116 to prevent build up of heat under workbench 110 as discussed in more detail below. Vent 127 can comprise a plurality of vertical slots 129 adjacent the upper edge of vertical plate 116. In the embodiment shown in FIG. 19, there can be 3 vents spaced across stringer 115 each having a plurality of slots 129. In the embodiment shown in FIG. 19 and FIG. 21 there can be 25 slots 129 in each vent 127 and the slots 129 can be 2 inches long and ¼ inch wide with alternate slots 129 offset by ½ inch. While stringer 115 is shown in this embodiment as a separate component from leg assemblies 111 to facilitate shipping, it will be appreciated by those skilled in the art that the stringer 115 could be permanently attached to leg assemblies 111 as by welding. Stringer 115 can be fabricated of metal such as steel. Leg assemblies 111 and stringer 115 can be finished as desired such as by painting. Those skilled in the art will recognize that the dimensions of the stringer and vents can be adjusted as desired.

Figure 23:
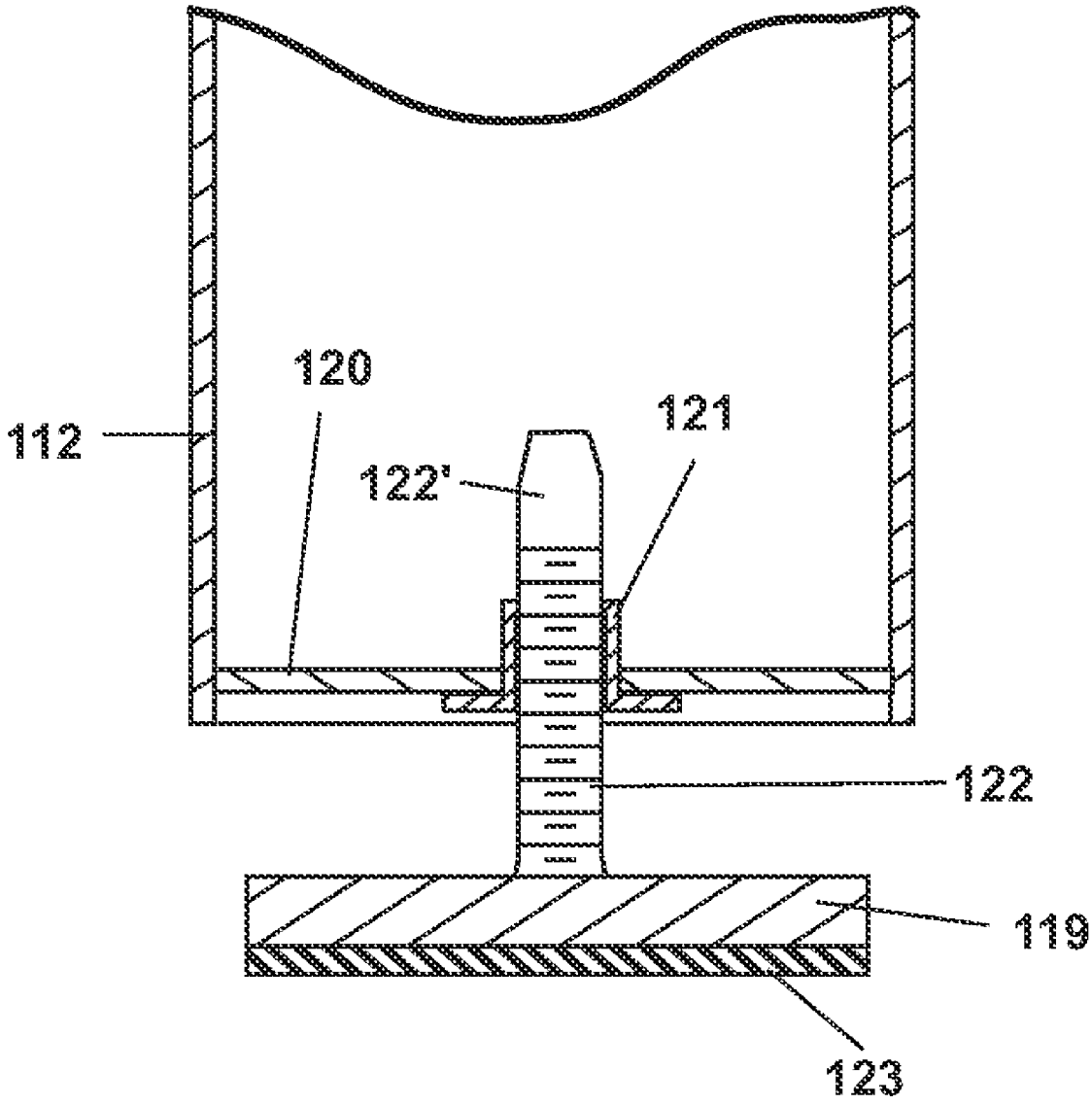
FIG. 23 is a partial sectional view of a workbench leg showing the leveling mechanism.

Referring to FIG. 21 and FIG. 23, each leg 112 can have a bottom wall 120 that can be welded into the bottom end of leg 112. Bottom wall 120 can have a threaded fastener such as a tee nut 121 welded in the center of bottom wall 120. A leveling foot 119 can be provided for each leg 112 that can include a threaded portion 122 fastened to foot 119 and adapted to be threaded into tee nut 121 in bottom wall 120. The top portion 122' of threaded portion 122 can be provided without threads to prevent threaded portion 122 from backing all the way out of tee nut 121 such as when workbench 110 is being moved across the floor. Providing the top portion 122' without threads can also facilitate assembly, in that one corner of the workbench can be lifted and a leveling foot 119 inserted into tee nut 121 without having to start the threads on threaded portion 122 upon insertion of threaded portion 122 into tee nut 121. Leveling foot 119 can have a pad 123 on the bottom surface to provide a non-slip surface on leveling foot 119. Pad 123 can be nylon or rubber or other material as will is well known to those skilled in the art. Those skilled in the art will understand that another form of leveling mechanism for some or all of the legs 112 could be provided as desired, or that a leveling mechanism could be omitted.

Elongated mounting holes 126 in top plate 114 and mounting holes 125 in mounting flange 117 can receive a plurality of fasteners 131 for attaching top 130 to the leg and stringer assembly 128. Fasteners 131 can be lag screws and pilot holes (not shown) can be pre-drilled in top 130 to facilitate locating and attaching top 130 to leg and stringer assembly 128. Mounting holes 126 are elongated in the plane of leg assembly 111 to allow for expansion and contraction of top 130 over the range of humidity conditions likely to be encountered in a non-climate controlled environment such as a basement, a garage or other outdoor work area. Thus, elongated mounting holes 126 are positioned to allow the width of the laminated hard wood maple top to expand and contract with changes in humidity. Mounting holes 125 in mounting flange 117 can be circular since laminated hard wood maple top 130 is unlikely to expand and contract along the direction of the laminated wood strips. In addition, use of round mounting holes 125 in mounting flange 117 can provide a sturdy workbench since the leg and stringer assembly can not shift under top 130 as the fasteners 131 can lock top 130 to the leg and stringer assembly 128. Those skilled in the art will understand that if top 130 is formed of strips of hard wood that run from front to back instead of side to side that mounting holes 126 could be round and mounting holes 125 elongated along the length of stringer 115 to allow for expansion and contraction in that direction.

Figure 22A:
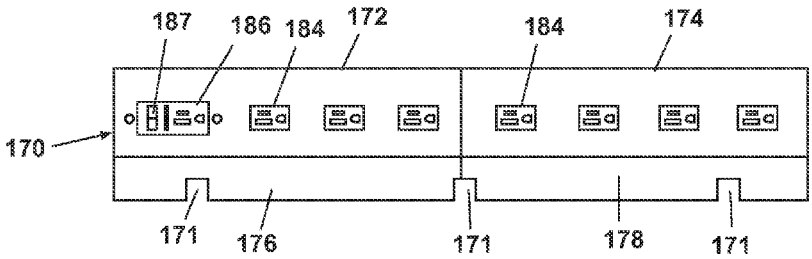
FIG. 22A is a schematic front view of the power strip.
Figure 22B:
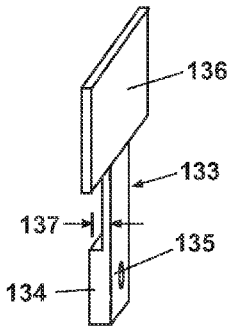
FIG. 22B is a schematic perspective view of a T-bracket for mounting a power strip to a modular workbench top.
Figure 22:
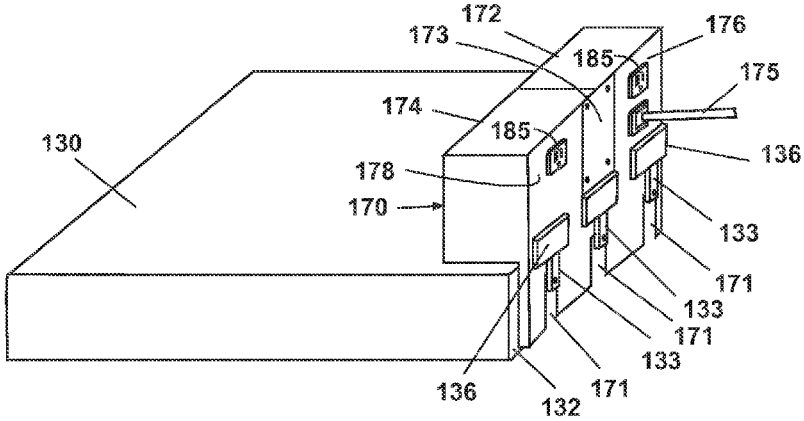
FIG. 22 is a schematic rear perspective view showing a power strip mounted on the modular workbench top.

Referring to FIG. 22, FIG. 22A and FIG. 22B, a schematic power strip 170 is shown mounted to a workbench top 130. A plurality of T-brackets 133 can be provided to lock power strip 170 in position on workbench 110. Each T-bracket 133 can be attached to the rear edge 132 of top 130 by fasteners such as conventional lag screws, not shown. T-bracket 133 can include a mounting portion 134 having a mounting hole 135 through which a mounting screw can be driven into rear edge 132 of top 130. Above mounting portion 134 there is an enlarged support portion 136 that can overlie rear panels 176 and 178 to hold power strip firmly on workbench top 130. Rear panels 176 and 178 can have slots 171 formed in the lower end of the rear panels to slide down over mounting portions 134 of T-brackets 133. Mounting portion 134 is thicker than support portion 136 by offset 137 which provides sufficient space for rear panels 176 and 178 of power strip sections 172 and 174 to be slid down between the rear edge 132 of workbench top 130 and support portions 136. The slots 171 in rear panels 176 and 178 can be dimensioned to snuggly fit over mounting portions 134 to hold the power strip 170 in place when installed on a workbench top 130. Those skilled in the art will recognize that power strip sections 172 and 174 could be mounted to workbench top 130 in other ways than as disclosed in FIG. 22-FIG. 22B.

Power strip 170 can be provided in two sections 172 and 174 that extend approximately the full width of top 130. While the embodiment of FIG. 22 and FIG. 22A shows has power strip 170 in two sections, those skilled in the art will recognize that the power strip could be provided in a single piece, and that power strip 170 could extend less than the full width of top 130. Power strip sections 172 and 174 can be joined by a connecting plate 173 attached to the rear panels 176 and 178 of power strip sections 172 and 174. A suitable electrical connector can be provided to electrically connect power strip sections 172 and 174 at the respective ends of power strip sections 172 and 174, not shown, and covered by connecting plate 173. A suitable power cord 175 can be provided at the rear panel 176 of section 172 to connect the power strip 170 to a power source, not shown. A suitable strain relief can be provided to mount power cord 175 to rear panel 176 as is well known to those skilled in the art. Power cord 175 can be provided in any desired length to readily connect power strip 170 to a power source. In the embodiment shown in FIG. 22, power cord 175 can be twenty feet long. A plurality of electrical outlets 184 can be provided on the front panels 180 and 182 of power strip sections 172 and 174. Electrical outlets 185 can be provided on rear panels 176 and 178 to provide a power source for a refrigerator module 160, a light fixture for workbench 110, not shown, or other electrically operated device that is not used on the workbench top 130. The electrical outlets 184, 185, can be commercially available panel outlets consisting of a terminal block and a cover that can be snapped into cutouts in the front and rear panels. In addition, a ground fault circuit interrupter (GFCI) outlet 186 can be provided on front panel 180 through which the other outlets 184 and 185 can be connected. GFCI outlet 186 can be provided with an on/off switch 187 and test and reset buttons as is well known in the art. After electrical outlets 184, 185 and GFCI outlet 186 are installed in the front and rear panels, the outlets can be connected by electrical wire to a power cord 175 as is well known to those skilled in the art. While a GFCI outlet is shown in the embodiment of FIG. 22 and FIG. 22A, GFCI outlet 186 could be replaced with an on/off switch, an overload protector or a surge protector or any combination thereof as is well known to those skilledin the art.

The power strip housing including front panels 180 and 182 and rear panels 176 and 178 can be can be formed of metal and painted as other metal parts of the modular workbench 110, although those skilled in the art will understand that a plastic housing could be used. After installation of the electrical outlets and connecting the electrical outlets and power cord, the power strip housing can be assembled using threaded fasteners as is well known to those skilled in the art.

Figure 24:
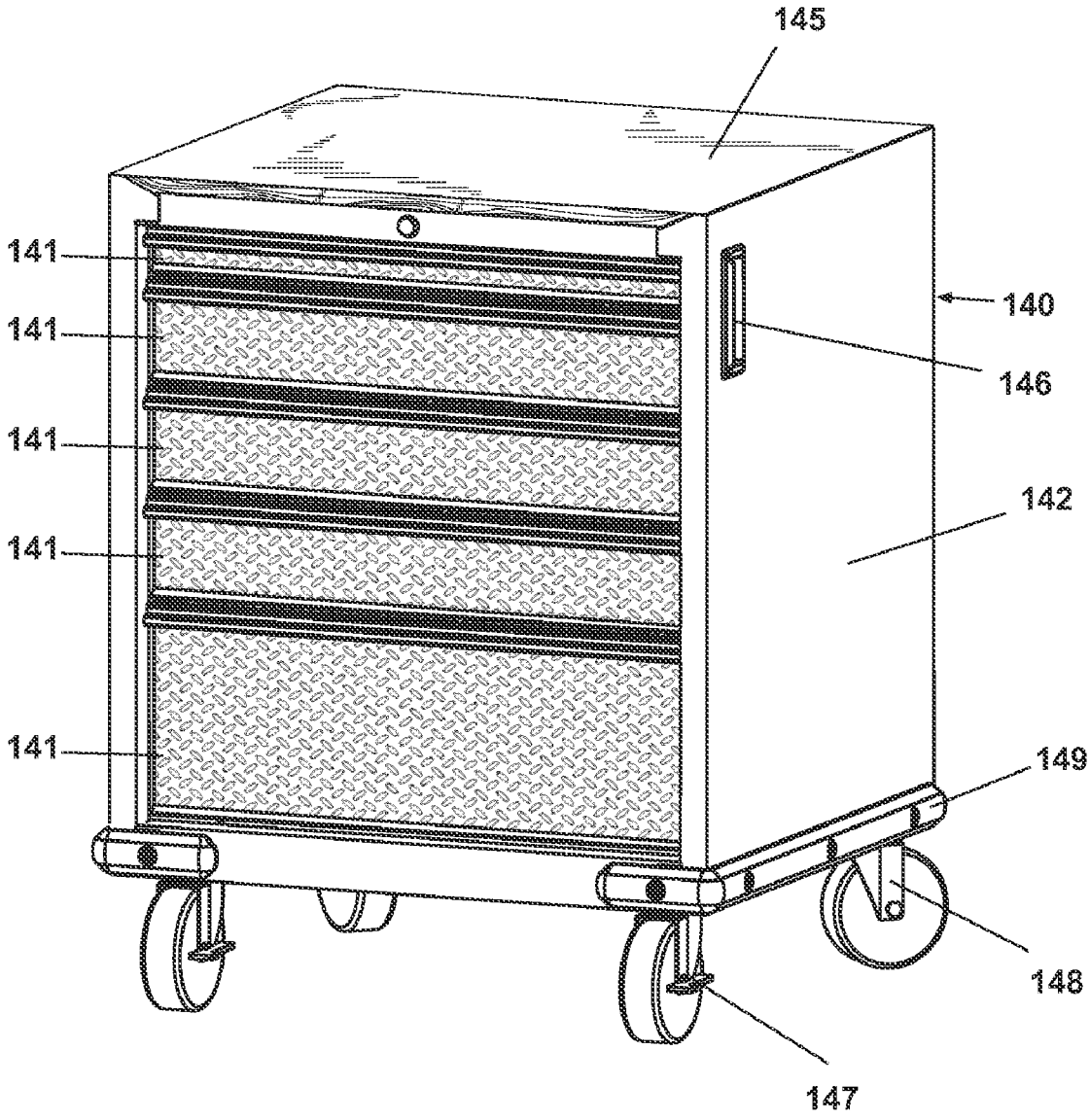
FIG. 24 is a front perspective view of a drawer module.
Figure 25:
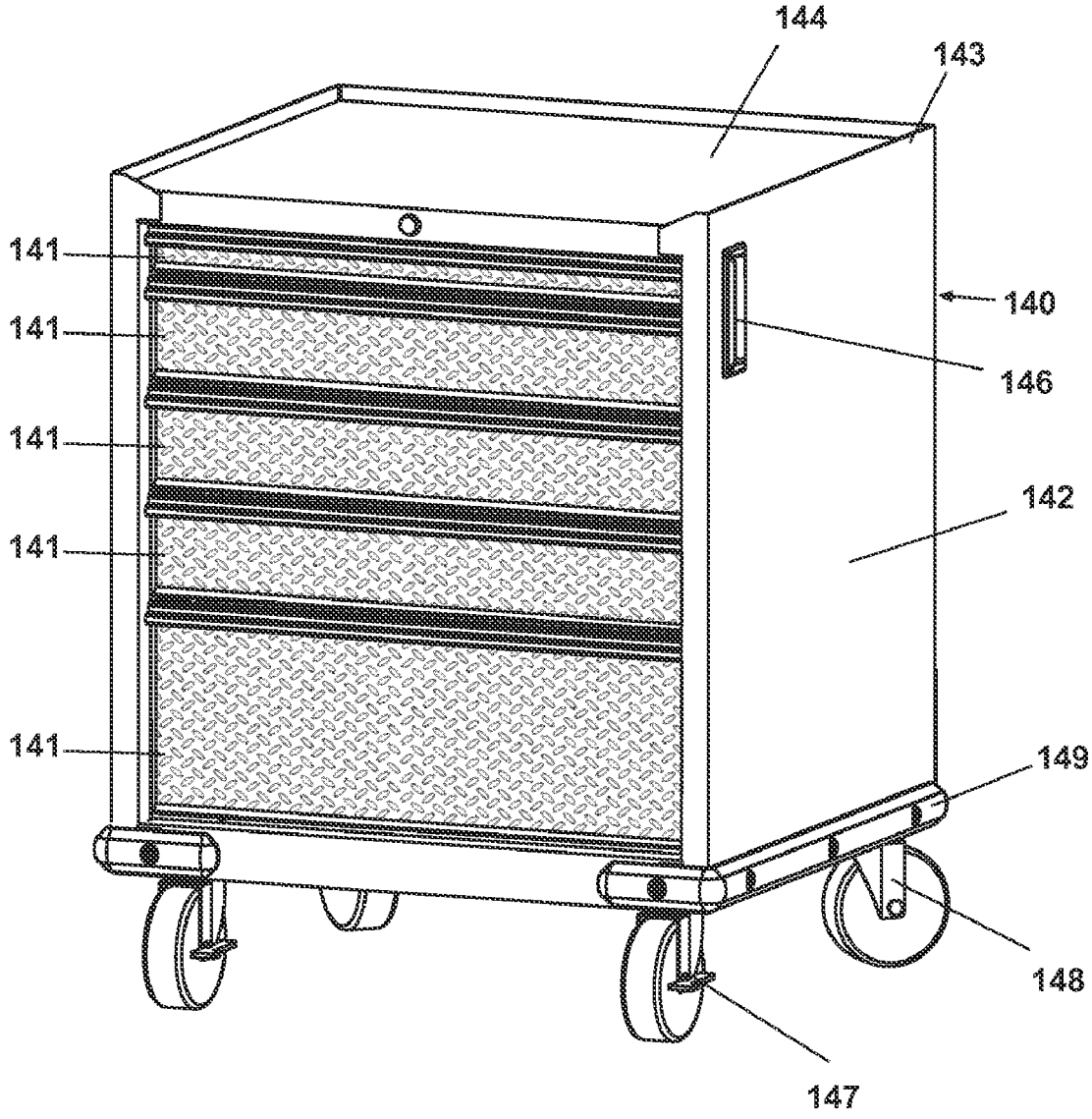
FIG. 25 is a front perspective view of a drawer module without the optional wood work surface.

Referring to FIG. 24 and FIG. 25, a drawer module 140 is shown. Drawer module 140 can have a plurality of drawers 141 each mounted on tracks for easy access as are well known to those skilled in the art. The face of each drawer 141 can have an ornamental treadplate pattern surface that is the subject of co-pending design Pat. application No. 29/173,442. Drawer module 140 can have a cabinet 142 having a raised top edge 143 that forms a work surface 144 and also can form a frame for an optional hardwood work surface 145 that can be sized to fit tightly inside raised top edge 143. Drawer module 140 can have a pair of fixed casters 147 mounted at the front of module 140 that are aligned with the sides of cabinet 142 to facilitate rolling drawer module 140 under and out from underneath workbench 110. Drawer module 140 can also have a pair of swivel casters 148 mounted at the rear of drawer module 140 to facilitate movement of drawer module 140 to any desired location. Casters 147 and 148 are large heavy-duty casters to provide a sturdy, stable module that can be used as a portable work surface. Casters 147 and 148 are also sized so that the height of drawer module 140 with casters installed is approximately the same height as the other modules (even though the cabinet height of other modules may differ) and so that drawer module 140 fits easily under workbench 110. Drawer module 140 can have side handles 146 in the side walls of cabinet 142 to facilitate moving drawer module 140. Side handles 146 allow a user to grasp both sides of cabinet 142 to position drawer module 140 as desired on casters 147 and 148. Drawer module 140 can also have a bumper 149 on the lower sidewalls of cabinet 142 that wraps around the front and rear corners of cabinet 142. Bumper 149 prevents adjoining modules from striking one another when being moved into and out of docking underneath workbench 110, or from striking other objects and damaging or scratching the cabinet walls. Bumper 149 can be fabricated of vinyl, other plastic material, or a mixture of plastic and rubber material, or other suitable bumper material as is well known to those skilled in the art. Bumper 149 can be attached to drawer module 140 using screws or other suitable fasteners. Fixed casters 147 can be locking casters as shown in the embodiment of FIG. 24 and FIG. 25 to facilitate use as a mobile work surface or to maintain drawer module 140 in position under workbench 110.

Figure 26:
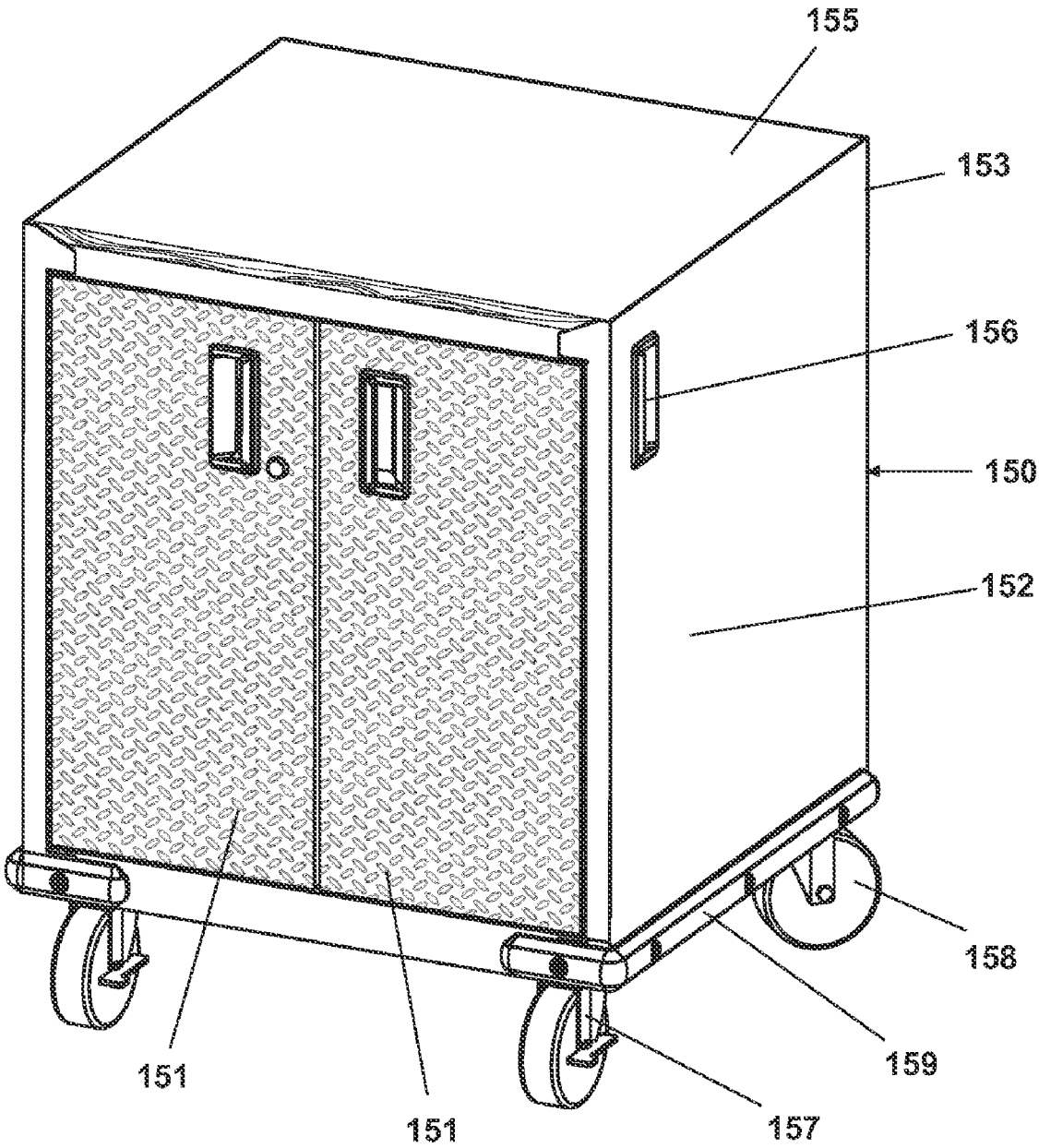
FIG. 26 is a front perspective view of a cabinet module.

Referring to FIG. 26, a storage cabinet module 150 is shown. Storage cabinet module 150 can have a pair of doors 151 hinged to the front edge of cabinet 152. Doors 151 can have an ornamental treadplate pattern surface that is the subject of co-pending design Pat. application No. 29/173,444. Storage cabinet module 150 can have a cabinet 152 having a raised top edge 153 that forms a work surface, not shown covered by hard wood work surface 155, and also can form a frame for an optional hardwood work surface 155 that can be sized to fit tightly inside raised top edge 153. Storage cabinet module 150 can have a pair of fixed casters 157 mounted at the front of storage cabinet module 150 that are aligned with the sides of cabinet 152 to facilitate rolling storage cabinet module 150 under and out from underneath workbench 110. Storage cabinet module 150 can also have a pair of swivel casters 158 mounted at the rear of storage cabinet module 150 to facilitate movement of storage cabinet module 150 to any desired location. Casters 157 and 158 are large heavy-duty casters to provide a sturdy stable module that can be used as a portable work surface. Casters 157 and 158 are also sized so that the height of storage cabinet module 150 with casters installed is approximately the same height as the other modules (even though the cabinet height of other modules may differ) and so that module 150 fits easily under workbench 110. Storage cabinet module 150 can have side handles 156 in the side walls of cabinet 152 to facilitate moving storage cabinet module 150. Side handles 156 allow a user to grasp both sides of cabinet 152 to position storage cabinet module 150 as desired on casters 157 and 158. Storage cabinet module 150 can also have a bumper 159 on the lower sidewalls of cabinet 152 that wraps around the front and rear corners of cabinet 152. Bumper 159 prevents adjoining modules from striking one another when being moved into and out of docking underneath workbench 110, or from striking other objects and damaging or scratching the cabinet walls. Bumper 159 can be fabricated of vinyl, other plastic material, or a mixture of plastic and rubber material, or other suitable bumper material as is well known to those skilled in the art. Bumper 159 can be mounted to module 150 using screws or other fasteners as desired. Fixed casters 157 can be locking casters as shown in the embodiment of FIG. 26 to facilitate use as a mobile work surface or to maintain storage cabinet module 150 in position under workbench 110.

Figure 27:
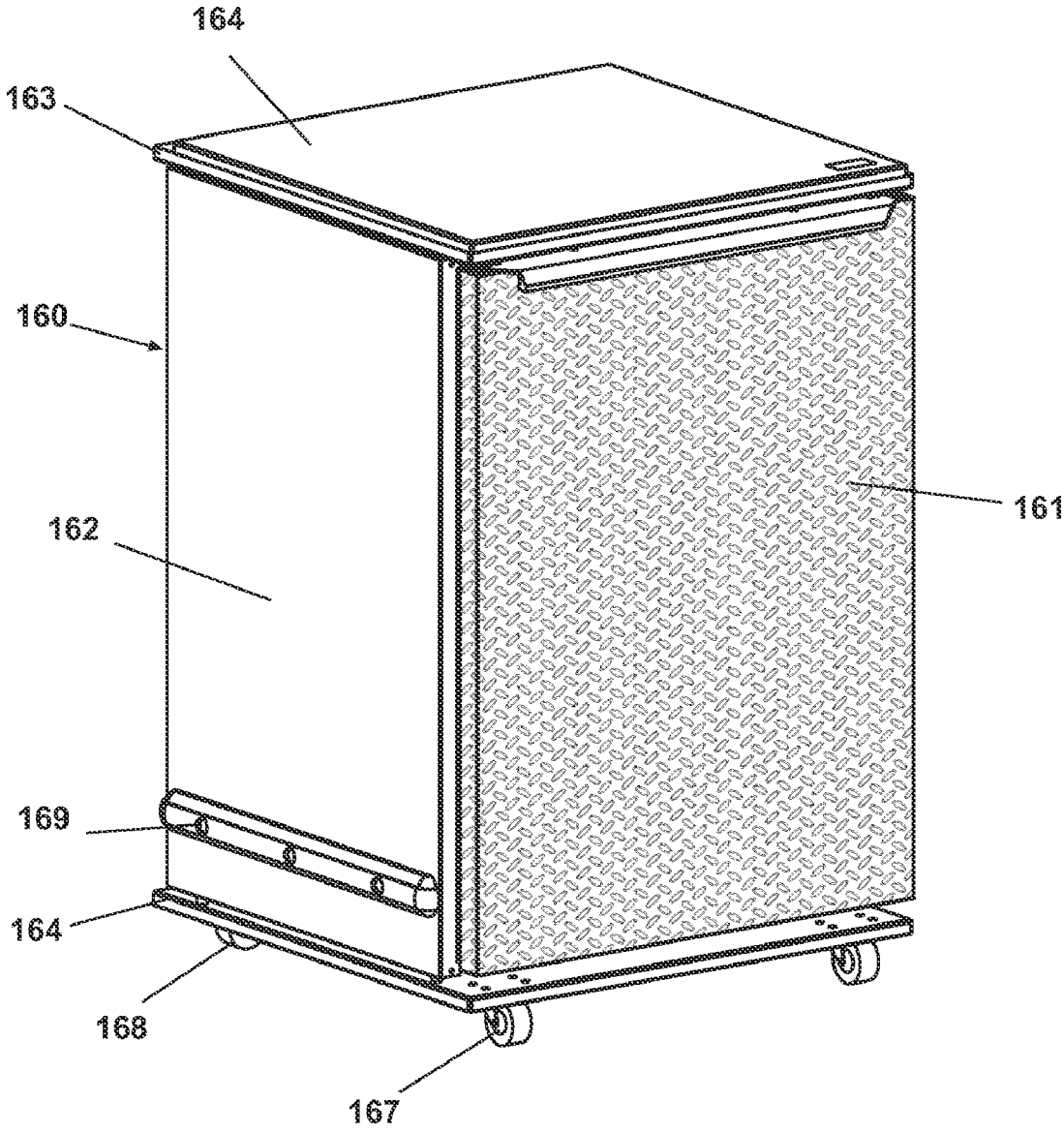
FIG. 27 is a front perspective view of a refrigerator module.

Referring to FIG. 27, a refrigerator module 160 is shown. As mentioned above, refrigerator module 160 can be a low ambient temperature refrigerator as disclosed in U.S. Pat. No. 7,191,827, which is incorporated by reference. Refrigerator module 160 can have a cabinet 162 having a hinged door 161 mounted on the front of cabinet 162. Door 161 can have an ornamental treadplate pattern surface that is the subject matter of co-pending design Pat. application No. 29/173,543. Refrigerator module 160 can have a top tray 163 and a bottom tray 164 that are attached to the top and bottom of cabinet 162. Top tray 163 can form a work surface 164 and also a frame for an option hardwood work surface, not shown, that can be sized to fit tightly inside top tray 163. Top tray 163 can have a vent, not shown, in the rear edge of tray 163 to facilitate cooling of a condenser, not shown, mounted on the rear wall of cabinet 162 as disclosed in the above identified U.S. Pat. No. 7,191,827, and incorporated by reference. The optional hardwood work surface can be sized to assure that the vent is not covered when a hardwood work surface is installed. Top tray 163 and bottom tray 164 can extend beyond the rear surface of cabinet 162 to protect the static condenser. Refrigerator module 160 can have a pair of fixed casters 167 mounted at the front of refrigerator module 160 that are aligned with the sides of cabinet 162 to facilitate rolling refrigerator module 160 under and out from underneath workbench 110. Refrigerator module 160 can also have a pair of swivel casters 168 mounted at the rear of refrigerator module 160 to facilitate movement of refrigerator module 160 to any desired location. Casters 167 and 168 are heavy-duty casters to provide a sturdy stable module that can be used as a portable work surface. Casters 167 and 168 are also sized so that the height of refrigerator module 160 with casters installed is approximately the same height as the other modules (even though the cabinet height of other modules may differ) and so that refrigerator module 160 fits easily under workbench 110. Module 160 can also have a bumper 169 on the lower sidewalls of cabinet 162. Bumper 169 prevents adjoining modules from striking one another when being moved into and out of docking underneath workbench 110, or from striking other objects and damaging or scratching the cabinet walls. Bumper 169 can be fabricated of vinyl, other plastic material, or a mixture of plastic and rubber material, or other suitable bumper material as is well known to those skilled in the art. Bumper 169 can be mounted to module 160 using screws or other fasteners as desired. Fixed casters 167 can be locking casters as shown in the embodiment of FIG. 27 to facilitate use as a mobile work surface or to maintain refrigerator module 160 in position under workbench 110.

Each of modules 140, 150 and 160 can be sized and provided with casters such that each of the modules fits easily under workbench 110. In the embodiment shown in FIG. 19, there can be approximately 1 and ½ inches clearance between the top of the modules with an optional hardwood work surface in place and the underneath side of top 130. While the modules disclosed in the embodiment of FIG. 19, FIG. 24, FIG. 25, FIG. 26 and FIG. 27 are approximately the same height when provided with casters as discussed above, those skilled in the art will recognize that the height of modules, with casters installed, could be substantially identical, or could be designed to differ in height as desired. The clearance space between the tops of modules 140, 150 and 160 coupled with vents 127 in stringer 115 provides adequate ventilation under workbench 110 when a refrigerator module 160 is in use and the condenser (not shown) is releasing heat under workbench 110. Those skilled in the art will recognize that vents 127 and/or the clearance space above modules 140, 150 and 160 can be changed as desired to provide more or less ventilation under workbench 110. Vents 127 can be located on stringer 115 to be centered with respect to each module, in embodiment of FIG. 19 and FIG. 21 three modules. Those skilled in the art will understand that if workbench 110 is modified to provide for docking of two or more that three modules the number of vents 127 in stringer 115 can be modified to correspond to the number of modules that can be docked under workbench 110.

Figure 28:
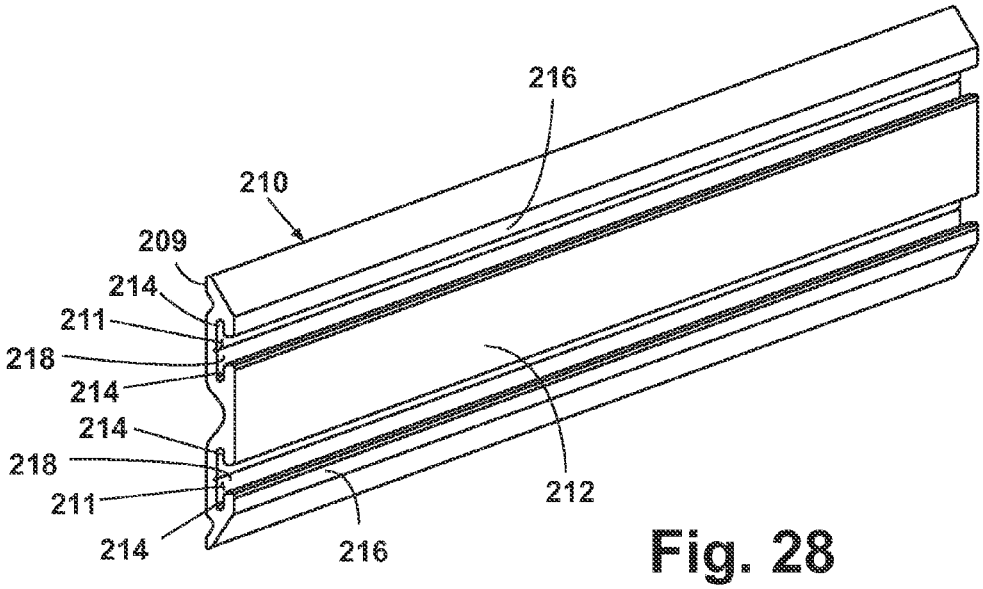
FIG. 28 is a perspective view of a slot track suitable for use in a space-efficient workroom storage system according to the invention.
Figure 33:
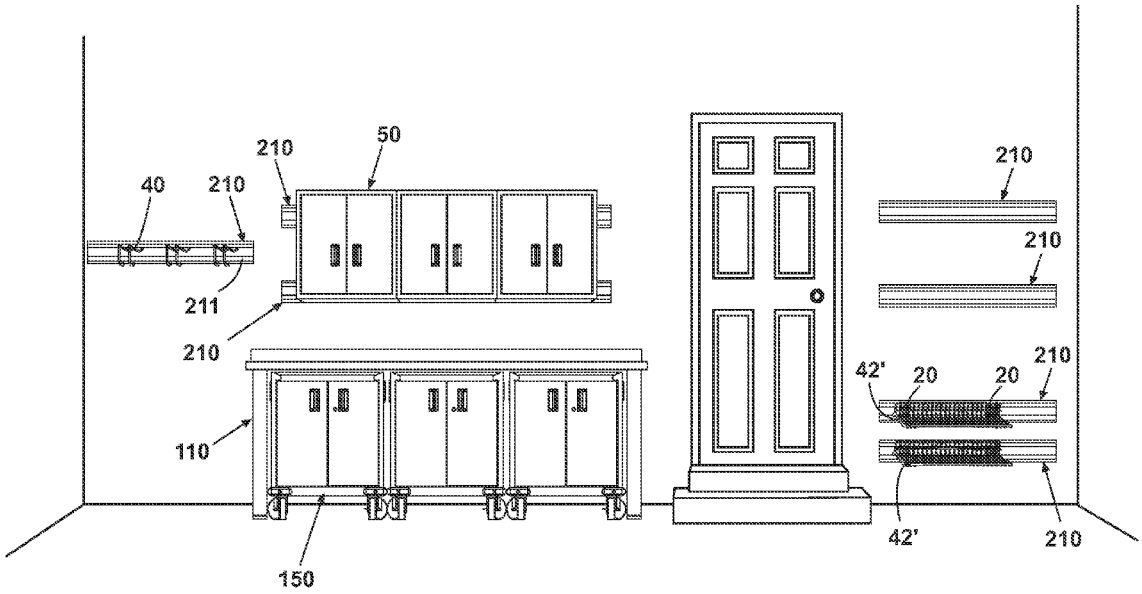
FIG. 33 is a perspective view of a space-efficient workroom storage system having plural slot tracks positioned on a wall supporting wall cabinets and tool hanger brackets for a modular workbench system.
Figure 34:
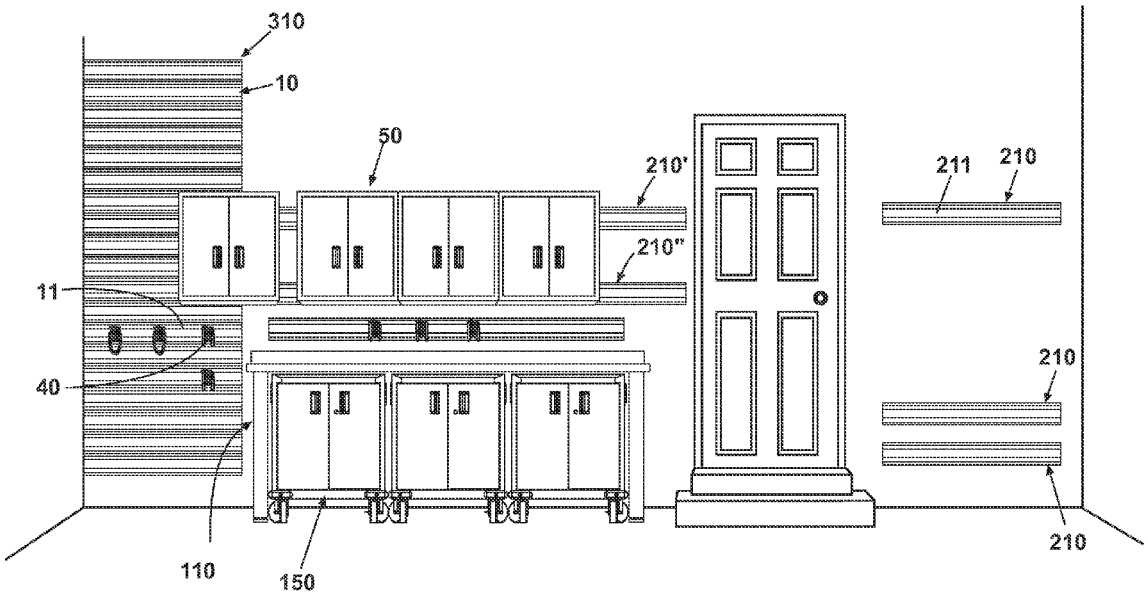
FIG. 34 is a perspective view of a space-efficient workroom storage system having plural slot tracks and slotwall panels mounted on a wall supporting wall cabinets and tool hanger brackets for a modular workbench system.

In accordance with the present invention a slot track storage system can incorporate a slot track 210 having a plurality of generally "T" shaped slots 211 forming at least one generally "T" shaped slats 212 that can be provided with a hanger bracket for mounting a device on the slot track. A variety of storage options can be provided as described above in conjunction with slotwall panels. Referring to FIG. 28, a slot track 210 is shown. It should be understood that the slot track 210 shown in FIG. 28 can extend longitudinally for any desired length. Typically, slot tracks can be extruded in 8 feet long lengths to facilitate handling and installation. However, it should be understood that slot tracks longer or shorter that 8 feet can be fabricated and used. Further, a single slot track can be used or multiple slot tracks can be mounted on one or more walls as shown in FIG. 33 and FIG. 34. While the slot tracks 210 shown in FIG. 28 through FIG. 32 include two slots 211 forming a slat 212, those skilled in the art will recognize that more than two slots 211 forming more than one slat 212 can be provided if desired. Slot track 210 can include upper and lower slots 211 having undercuts 214 in the sidewalls of the slots 211 and a bottom wall 218. Undercuts 214 form edges 213 in the slots 211. On the sides of slots 211 opposite slat 212 the edges 216 of slot track 210 extend away from the slots 211 and then taper toward the rear surface 209 of the slot track 210.

Slot tracks 210 can be mounted on a wall in a manner similar to slotwall panels 10. In a wall installation, screws (not shown) can be driven through the bottom wall 218 of slot track 210 along groove 219 into studs supporting the wall to mount the slot track or tracks 210 to the wall as is well known to those skilled in the art. Mounting screws (not shown) can be driven in one or both slots 211 through groove 219 every 16 or 24 inches into studs supporting the wall. Those skilled in the art will recognize that the spacing of mounting screws can be modified to align with studs supporting the wall on which the slot track(s) is mounted. Similarly, those skilled in the art will recognize that slot tracks 210 can be mounted to a concrete or concrete block wall using screws (not shown) and suitable anchors well known in the art.

Figure 29:
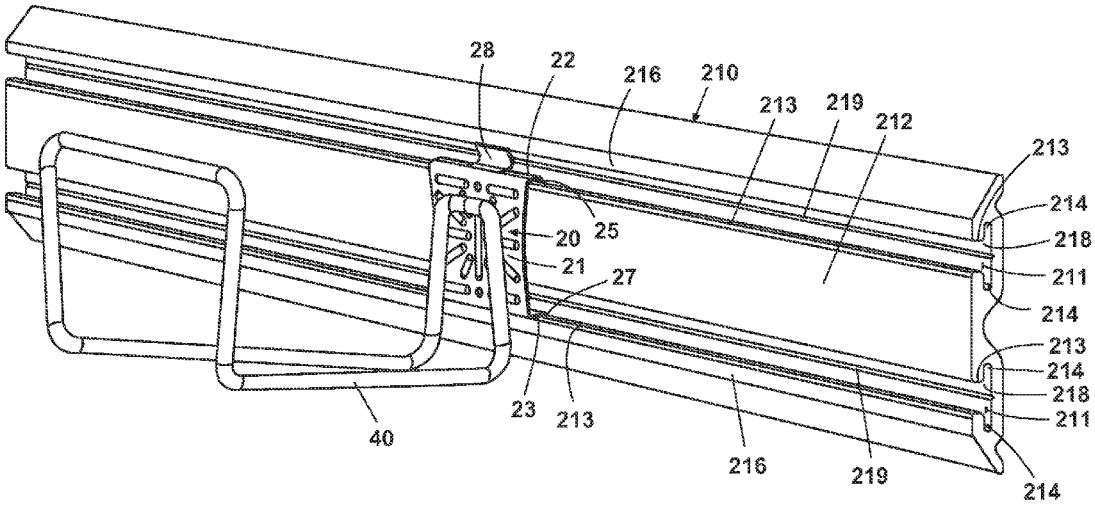
FIG. 29 is a partial perspective view of a slot track of FIG. 28 with a hanger bracket mounted on the slot track.

Turning to FIG. 29, one embodiment of a hanger bracket 20 is shown mounted on the track 210 and is shown with one example of a hook device 40 attached to the hanger bracket 20. Another embodiment of a hook device 40' is shown in FIG. 13. Other well known and available hooks and hanging devices can be attached to one or more hanger brackets 20 as will be understood by one skilled in the art. While a few examples of types of hook and other storage devices that can be attached to one or more hanger brackets are disclosed in this application, one skilled in the art will understand that there are many available hooks and storage devices available on the market that could be used with the brackets and slot tracks according to this invention.

Mounting of hanger bracket 20 to a slot track 210 can be understood by referring to FIG. 29. The slot track 210 as shown in FIG. 28 through FIG. 32 can include the same slot and slat geometry as a slotwall panel 10 as described conjunction in FIG. 1 through FIG. 4, and can be used in conjunction with the same hanger brackets 20 that can be used with slotwall panels 10. Referring to FIG. 29 generally "J" shaped hook 22 hooks over an edge 213 of a generally "T" shaped slat 212. Generally "J" shaped hook 23 hooks behind lower edge 216 in undercut 214. Spring arm 28 is positioned behind upper edge 216 in undercut 214. Hanger bracket 20 interacts with slot track 210 in the same way as with a slotwall panel 10 as described above in connection with FIG. 1 through FIG. 4. Thus, hanger bracket 20 is locked in position on slot track 210 by friction due to spring arm 28 whether loaded or unloaded. Accordingly, hanger bracket 20 and its attached device, whether loaded or unloaded, can not inadvertently be knocked off or dislodged from a slot track 210.

Hanger bracket 20, together with any attached device such as device 40, can be mounted to a slot track 210 by inserting spring arm 28 into the undercut 214 in a slot 211 far enough under the upper edge 216 for leg 25 to clear edge 213 of slat 212. Hanger bracket 20 can then be pivoted down against the moment of spring arm 28 until leg 27 clears the edge 213 of lower edge 216. Hanger bracket 20 can then be slid down over slat 212 until leg 25 rests on edge 213 with leg 27 bearing against the underside of the lower edge 216 in undercut 214. Thus, hanger bracket 20 can mount on slot track 210 the same as hanger bracket 20 mounts on a slotwall panel 10, see FIG. 2. As mentioned above, hanger bracket 20 will be held in place by friction resulting from the moment of spring arm 28 bearing against the inside surface of the upper edge 216 in undercut 214. For convenience in describing attaching of a bracket 20 to a slot track 210, edges 216 have been described as upper and lower edges 216. Slot track 210 as shown in the embodiment of FIG. 28 through FIG. 32 can be symmetrical so that "upper" and "lower" has no significance other than a reference to understand the description since slot tracks 210 can be mounted on a wall with either edge "up".

Figure 31:
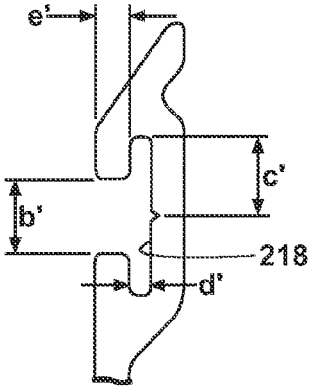
FIG. 31 is an enlarged partial end view of a slot track of FIG. 30 showing the configuration of the edge of a slot track.
Figure 30:
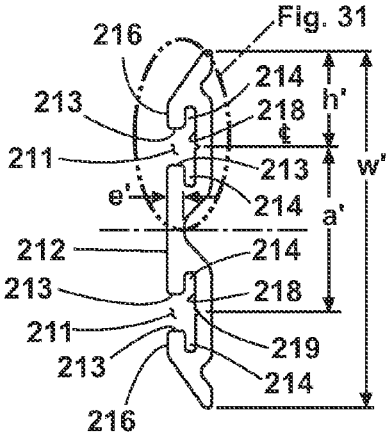
FIG. 30 is an end view of a slot track of FIG. 28 showing the spacing of the generally "T" shaped slots.

Referring to FIG. 30 and FIG. 31, the dimensions of one embodiment of a slot track 210 can be as provided in the following table. It should be understood that the following dimensions are approximate and that slotwall panels having different dimensions can be provided in accordance with the invention as desired.

| Description | Reference | Dimension (mm) |
|---|---|---|
| Width of slot track 210 | w' | 165 |
| Center to center of "T" shaped slots 211 | a' | 76.2 |
| Width of "T" shaped slot opening | b' | 17 |
| Center of slot to end of undercut 214 | c' | 18.5 |
| Depth of undercut 214 | d' | 5 |
| Thickness of slat 212 | e' | 7 |
| Center of slot 211 to edge of slot track 210 | h' | 44.5 |

Hanger brackets 20 as described above in FIG. 2, FIG. 5 and FIG. 6A including the dimensions of the embodiment of a hanger bracket 20 described in conjunction with those figures can be used with a slot track as shown in FIG. 28 through FIG. 32. It will be appreciated by those skilled in the art that the dimensions referenced above are approximate and that a hanger bracket having different dimensions can be provided in accordance with the invention as desired for use with slot tracks having different dimensions.

Figure 32:
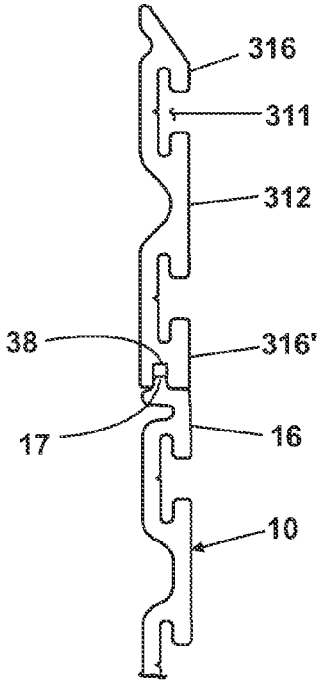
FIG. 32 is a partial end view of another embodiment of a slot track suitable for use in a space-efficient workroom storage system according to the invention configured to be the finishing the edge of a slotwall panel and positioned on a slotwall panel.

Turning to FIG. 32, another embodiment of slot track 310 is mounted on an edge of a slotwall panel 10. When slotwall panels 10 are used to cover less than a full wall of a workroom, the upper or lower edge of a slotwall panel 10 can present a connecting rib 17 or a connecting groove 18 on the exposed edge(s) of the slotwall panel(s) 10. In order to provide a finished edge, a slot track 310 having a half slat 316' on one edge can be provided. Slot track 310 can include a connecting groove 318 on one edge adjacent half slat 316' in order to mate with the connecting rib 17 of a slotwall panel 10. The dimensions of the half slat 316' and connecting groove 318 can be the same as the corresponding components of a slotwall panel 10 described above. While slot track 310 is shown with a connecting groove 318 on one edge, those skilled in the art will appreciate that slot track 310 can be provided with a connecting rib, not shown, on one edge in lieu of connecting groove 318 in order for the slot track 310 to mate with an exposed connecting groove 18. Should a connecting rib, not shown, be provided it can have the same dimensions as the connecting rib 17 included in slotwall panels 10. Those skilled in the art will understand that slot tracks 310 having a connecting rib and other slot tracks having a connecting groove can be provided for use with slotwall panels having both edges exposed to form a finished storage system.

FIG. 33 illustrates a modular workbench storage system 110 in combination with a slot track storage system in a workroom. The modular workbench storage system 110 can include a heavy duty workbench and storage space for one or more modules that can dock underneath the workbench to minimize the area of the consumed in the room and thereby maximize the useful area of the workroom all as described above in connection with FIG. 19 through FIG. 27. When combined with the slot track storage system and wall-mounted storage cabinet previously described, the workbench storage system provides the operator of a workroom with a highly flexible and very space-efficient storage system. In the embodiment shown in FIG. 33, a plurality of slot tracks 210 are shown mounted on a wall of the workroom. Some of the slot tracks 210 have one or more hangers 40 installed on the slot tracks. Three wall cabinets 50 are shown mounted on a pair of slot tracks 210 mounted on the workroom wall over the workbench system 110. Slot tracks 210 can be mounted on the workroom wall spaced so that wall cabinets can be mounted in the same manner as wall cabinets are mounted on slotwall panels as described above in connection with FIG. 7 through FIG. 12. Wire form shelves 42' having brackets 20 can be mounted on the workroom wall for storing items off the floor of the workroom.

FIG. 34 illustrates another embodiment of workroom having a modular workbench storage system 110 in combination with a slotwall and slot track storage system in a workroom. The workroom in this embodiment has a plurality of slot tracks 210 mounted on a wall of the workroom, and also has a plurality of slotwall panels 10 covering a portion of one section of a wall of the workroom. A pair of the slot tracks 210' and 210" are shown mounted to align with slots in a slotwall panel 10. In addition, a slot track 310 is shown positioned at the top of series of slotwall panels to provide a finished top edge. When one or more slot tracks 210 are mounted adjacent one or more slotwall panels with slots in the slot tracks aligned with slots in the slotwall panel, devices such as a wall cabinet 50 can be installed partially on a slotwall panel and partially on a slot track. Slot tracks 210 can be dimensioned so that they can be mounted on a wall spaced apart an even number of slot track widths apart with the slots 211 lined up with slots 11 of a slotwall panel 10. Then, if desired, additional slot tracks 210 can be added between slot tracks already mounted on a wall, in each case with slots 211 aligned with the slots 11 of a slotwall panel 10. Those skilled in the art will also recognize that one or more slot tracks 210 can be mounted at any convenient height on a wall of a workroom to support hanger brackets for storing tools and equipment in the workroom, or for supporting shelves, baskets or other storage devices.

While the invention has been specifically described in connection with certain specific embodiments thereof, it is to be understood that this is by way of illustration and not of limitation, and the scope of the appended claims should be construed as broadly as the prior art will permit.

We claim:

1. A workroom organization system for space-efficient, organized storage of workroom items, such as tools and supplies used in a workroom, comprising:

a plurality of slot tracks mountable on a wall of the workroom each having at least two slots defining at least one slat;

a plurality of removable mounting brackets having a first "J" shaped hook on one edge opening in a first direction to hook over an edge of the at least one slat on the slot tracks and a second "J" shaped hook opening in the first direction to hook over an edge of a slot adjoining the slat engaging the first "J" shaped hook;

at least one wall-mounted storage cabinet having at least one mounting bracket to engage at least one slot track;

a workbench comprising a work surface and multiple legs extending from the work surface to support the work surface above a floor and defining a workbench recess beneath the work surface; and at least one mobile storage cabinet having a top surface located at a height such that the at least one mobile storage cabinet can be received within the workbench recess with the top surface underlying the work surface and having wheels extending from the mobile storage cabinet to support the mobile storage cabinet on the floor to ease the movement of the mobile storage cabinet into and out of the workbench recess;

wherein the workroom organization system enables a user to mount workroom items on mounting brackets mounted on the plurality of slot tracks and to arrange the at least one wall-mounted storage cabinet, workbench and at least one mobile storage cabinet within the workroom in a manner most space-efficient for a particular workroom while permitting the easy relocation of the workroom items and rearrangement of the at least one wall-mounted storage cabinet, workbench, and at least one mobile storage cabinet as needed over time as the quantity and mix of workroom items changes.

2. The workroom organization system of claim 1 wherein at least two slot tracks are mounted spaced vertically on a wall and the at least one wall-mounted storage cabinet includes at least two vertically spaced mounting brackets mounted to the rear wall of the storage cabinet to engage the vertically spaced slot tracks.

3. The workroom organization system of claim 2 wherein the vertically spaced mounting brackets include a top mounting bracket attached adjacent the top of the cabinet in a fixed vertical position on the cabinet and an additional mounting bracket attached to the cabinet below the top mounting bracket in a position such that the additional mounting bracket rests on the edge of a slot track slot.

4. The workroom organization system according to claim 3, wherein the at least one mobile storage cabinet comprises one of:

a general storage cabinet comprising an open-face cabinet defining a storage recess and at least one door moveable between an opened position and a closed position for selectively closing the open face;

a drawer storage cabinet comprising an open-faced cabinet defining a storage recess and at least one drawer slidably mounted to the open-faced cabinet for movement through the open face between a stored position, where the drawer is received within the storage recess, and a use position, where at least a portion of the drawer extends beyond the open face to permit access to the drawer; and a refrigerated cabinet having a refrigeration system for cooling the interior of the refrigerated cabinet.

5. The workroom storage system of claim 4 further comprising multiple mobile storage cabinets.

6. A workroom organization system for space-efficient, organized storage for workroom items, such as tools and supplies used in a workroom, comprising:

at least one slotwall panel mountable on a wall of the workroom having multiple slots defining a plurality of slats;

a least one slot track mountable on a wall of the workroom having two slots defining a slat;

a plurality of removable mounting brackets having a first "J" shaped hook on one edge opening in a first direction to hook over an edge of a slat on the at least one slotwall panel or the at least one slot track and a second "J" shaped hook opening in the first direction to hook over an edge of a slot adjoining the slat engaging the first "J" shaped hook;

at least one wall-mounted storage cabinet having at least one mounting bracket having a "J" shaped hook to hook over the edge of a slat on the at least one slotwall panel or the at least one slot track;

a workbench comprising a work surface and multiple legs extending from the work surface to support the work surface above a floor and defining a workbench recess beneath the work surface; and at least one mobile storage cabinet having a top surface located at a height such that the at least one mobile storage cabinet can be received within the workbench recess with the top surface underlying the work surface and having wheels extending from the mobile storage cabinet to support the mobile storage cabinet on the floor to ease the movement of the mobile storage cabinet into and out of the workbench recess;

wherein the workroom organization system enables a user to mount workroom items on removable mounting brackets on the at least one slotwall panel or the at least one slot track and arrange the at least one wall-mounted storage cabinet, workbench and at least one mobile storage cabinet within the workroom in a manner most space-efficient for a particular workroom while permitting the easy relocation of the workroom items and rearrangement of the at least one wall-mounted storage cabinet, workbench, and at least one mobile storage cabinet as needed over time as the quantity and mix of workroom items changes.

7. The workroom organization system of claim 6 wherein a plurality of slotwall panels are mounted on at least a portion of at least one wall of the workroom and a plurality of slot tracks are mounted on a portion of at least one wall of the workroom and at least two of the slot tracks are mounted spaced vertically on a portion of a wall and the at least one wall-mounted storage cabinet includes at least two vertically spaced mounting brackets mounted to the rear wall of the storage cabinet to engage and mount the storage cabinet on the vertically spaced slot tracks or on one or more of the slotwall panels.

8. The workroom organization system of claim 6 wherein two or more slot tracks are mounted vertically spaced adjacent one or more slotwall panels such that the slots in the slot tracks align with the slots in the slotwall panel and the at least one wall-mounted storage cabinet includes at least two vertically spaced mounting brackets mounted to the rear wall of the storage cabinet to engage and mount the storage cabinet on the vertically spaced slot tracks and on one or more of the slotwall panels.

9. The workroom organization system according to claim 6, wherein the at least one mobile storage cabinet comprises one of:

a general storage cabinet comprising an open-face cabinet defining a storage recess and at least one door moveable between an opened position and a closed position for selectively closing the open face;

a drawer storage cabinet comprising an open-faced cabinet defining a storage recess and at least one drawer slidably mounted to the open-faced cabinet for movement through the open face between a stored position, where the drawer is received within the storage recess, and a use position, where at least a portion of the drawer extends beyond the open face to permit access to the drawer; and a refrigerated cabinet having a refrigeration system for cooling the interior of the refrigerated cabinet.

10. The workroom storage system of claim 9 further comprising multiple mobile storage cabinets.

* * * * *